US008865380B2

(12) United States Patent
Noguchi et al.

(10) Patent No.: US 8,865,380 B2
(45) Date of Patent: Oct. 21, 2014

(54) ELECTROPHOTOGRAPHIC PHOTOSENSITIVE MEMBER, PROCESS CARTRIDGE, AND ELECTROPHOTOGRAPHIC APPARATUS

(75) Inventors: Kazunori Noguchi, Suntou-gun (JP); Harunobu Ogaki, Suntou-gun (JP); Shio Murai, Namazu (JP); Atsushi Ochi, Hino (JP); Koji Takahashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 620 days.

(21) Appl. No.: 13/007,439

(22) Filed: Jan. 14, 2011

(65) Prior Publication Data

US 2011/0177438 A1 Jul. 21, 2011

(30) Foreign Application Priority Data

Jan. 15, 2010 (JP) ..... 2010-006850
Jan. 12, 2011 (JP) ..... 2011-003785

(51) Int. Cl.

*G03G 5/04* (2006.01)
*G03G 15/00* (2006.01)
*G03G 5/05* (2006.01)
*G03G 5/06* (2006.01)

(52) U.S. Cl.

CPC ..... *G03G 5/056* (2013.01); *G03G 15/75* (2013.01); *G03G 5/0578* (2013.01); *G03G 5/0614* (2013.01); *G03G 5/0564* (2013.01)
USPC ..... 430/58.2; 430/59.6; 399/111; 399/159

(58) Field of Classification Search

USPC ..... 430/59.6, 58.2; 399/111, 159
See application file for complete search history.

(56) References Cited

U.S. PATENT DOCUMENTS 6,991,881 B2 1/2006 Ogaki et al.
6,994,941 B2 2/2006 Tanaka et al.
7,001,699 B2 2/2006 Tanaka et al.
7,045,261 B2 5/2006 Tanaka et al.

(Continued)

FOREIGN PATENT DOCUMENTS

JP 2005-242373 A 9/2005
JP 2007-4133 A 1/2007

(Continued)

OTHER PUBLICATIONS

Okuda, et al., U.S. Appl. No. 13/059,629, International Filing Date Sep. 24, 2009.

*Primary Examiner* — Peter Vajda
*Assistant Examiner* — Olatunji Godo
(74) *Attorney, Agent, or Firm* — Fitzpatrick, Cella, Harper and Scinto

(57) ABSTRACT

A charge transport layer, which is the surface layer of an electrophotographic photosensitive member, contains a charge transporting material, and a polyester resin A having a repeating structural unit including a specific siloxane moiety and at least one of a polyester resin C having a specific structure and a polycarbonate resin D having a specific structure as a binder resin. The content of the siloxane moiety in the polyester resin A is from 5% by mass or more to 30% by mass or less based on the total mass of the polyester resin A. The charge transport layer includes a domain made of the polyester resin A in a matrix made of the charge transporting material and at least one of the polyester resin C and the polycarbonate resin D.

5 Claims, 1 Drawing Sheet

(56) References Cited

U.S. PATENT DOCUMENTS

| | | | | |
|---|---|---|---|---|
| 7,364,824 | B2 | 4/2008 | Kikuchi et al. | |
| 7,402,366 | B2 | 7/2008 | Hayata et al. | |
| 7,413,840 | B1 | 8/2008 | Ogaki et al. | |
| 7,551,878 | B2 | 6/2009 | Ogaki et al. | |
| 7,553,594 | B2 | 6/2009 | Ogaki et al. | |
| 7,585,604 | B2 | 9/2009 | Ogaki et al. | |
| 7,622,238 | B2 | 11/2009 | Uematsu et al. | |
| 7,629,102 | B2 | 12/2009 | Ochi et al. | |
| 7,645,547 | B2 | 1/2010 | Okuda et al. | |
| 7,655,370 | B2 | 2/2010 | Kitamura et al. | |
| 7,704,657 | B2 | 4/2010 | Uesugi et al. | |
| 7,718,331 | B2 | 5/2010 | Uematsu et al. | |
| 7,749,667 | B2 | 7/2010 | Kawahara et al. | |
| 7,799,496 | B2 | 9/2010 | Uesugi et al. | |
| 7,838,190 | B2 | 11/2010 | Ogaki et al. | |
| 7,875,410 | B2 * | 1/2011 | Ogaki et al. | 430/58.8 |
| 7,927,774 | B2 | 4/2011 | Ogaki et al. | |
| 7,931,848 | B2 | 4/2011 | Ochi et al. | |
| 2010/0092208 | A1 * | 4/2010 | Ogaki et al. | 399/111 |

FOREIGN PATENT DOCUMENTS

| | | | |
|---|---|---|---|
| JP | 2007-79555 | A | 3/2007 |
| JP | 2009-84556 | A | 4/2009 |
| JP | 2009084556 | * | 4/2009 |

* cited by examiner

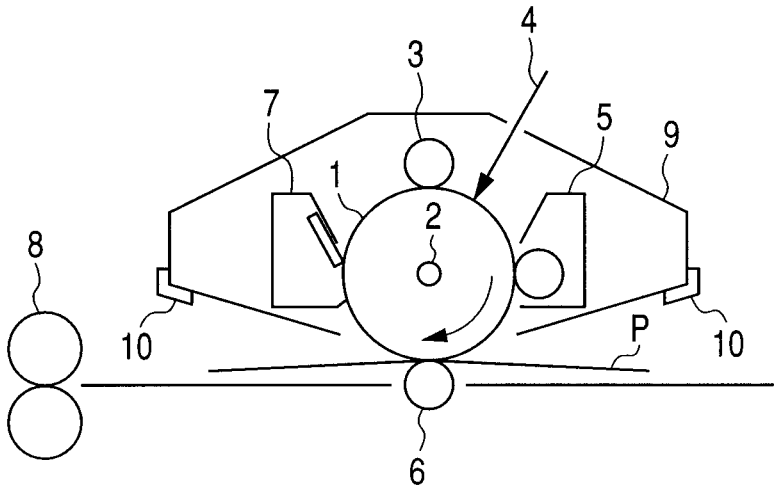
4
3
7
5
9
1
2
8
10
P
10
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge and an electrophotographic apparatus which have the electrophotographic photosensitive member.

2. Description of the Related Art

As photoconductive materials (a charge generating material and a charge transporting material) used for an electrophotographic photosensitive member mounted on an electrophotographic apparatus, organic photoconductive materials have been energetically developed. Usually, the electrophotographic photosensitive members using an organic photoconductive material have a photosensitive layer formed by coating a support with a coating liquid obtained by dissolving and dispersing an organic photoconductive material and a resin (binder resin) in a solvent, and drying this coating liquid. The layer structure of the photosensitive layer usually has a lamination type (regular type) structure obtained by forming a charge generation layer and a charge transport layer from the support side in this order.

The electrophotographic photosensitive member using an organic photoconductive material does not satisfy all the properties needed for an electrophotographic photosensitive member. In an electrophotography process, various objects such as a developer, a charging member, a cleaning blade, paper and a transfer member (hereinafter, sometimes referred to as a "contacting member or the like") are brought into contact with the surface of the electrophotographic photosensitive member. The electrophotographic photosensitive member is required to have properties of reducing deterioration of images caused by contact stress when the electrophotographic photosensitive member comes into contact with these contacting members. Particularly, in recent years, as durability of the electrophotographic photosensitive member is improved, it is desired that an effect of reducing deterioration of images caused by the contact stress be sustained.

With respect to relaxation of the contact stress, there is a proposal that a siloxane-modified resin having a siloxane structure in the molecular chain is contained in the surface layer of an electrophotographic photosensitive member coming into contact with the above-mentioned various contacting members. For example, Japanese Patent Application Laid-Open No. 2009-084556 discloses a polyester resin having a siloxane structure and a polyamide structure incorporated into it. Japanese Patent Application Laid-Open No. 2007-004133 discloses a technique for using a block copolymer resin material having a siloxane structure to form a domain in the surface layer of an electrophotographic photosensitive member. Similarly, Japanese Patent Application Laid-Open No. 2005-242373 discloses a technique for using a silicone material in the state where the silicone material is dispersed in the form of particles in a charge transport layer of an electrophotographic photosensitive member, and teaches that discharge breakdown is effectively prevented, and deterioration of images (black dots) can be suppressed.

However, Japanese Patent Application Laid-Open No. 2009-084556 discloses a copolymer resin of a polyamide resin and a polyester resin into which a siloxane structure is incorporated (organosiloxane copolymerized polyester amide resin). In the case where these resins are simply used for the electrophotographic photosensitive member, an aggregate of the charge transporting material may be formed in the polyester resin, causing inferior potential stability when the electrophotographic photosensitive member is repeatedly used. In Japanese Patent Application Laid-Open No. 2009-084556, the length of the siloxane chain is devised for improvement in transparency. Japanese Patent Application Laid-Open No. 2009-084556, however, does not describe forming a matrix-domain structure of one resin and other resin. Moreover, there is description about imparting water repellency. Thereby, initial slip properties are improved, but continuation of slip properties when the electrophotographic photosensitive member is repeatedly used is not sufficiently attained.

In the electrophotographic photosensitive members disclosed in Japanese Patent Application Laid-Open No. 2007-004133 and Japanese Patent Application Laid-Open No. 2005-242373, keeping electrophotographic properties cannot be compatible with continuous reduction in the contact stress.

A material disclosed by Japanese Patent Application Laid-Open No. 2007-004133 is a resin having a component with low surface energy and a matrix component in the same resin. It is shown that the component with low surface energy forms a domain to provide a low surface energy state. A siloxane moiety that manifests the low surface energy state has high surface migration properties (interface migration properties), and is likely to exist at an interface of the charge transport layer close to the charge generation layer. For this reason, the siloxane moiety may cause deterioration of potential fluctuation in a laminated photosensitive member. Also in the electrophotographic photosensitive member produced using a material described in Japanese Patent Application Laid-Open No. 2007-004133, potential fluctuation due to the above-mentioned factor may be produced.

Also in the photosensitive member disclosed in Japanese Patent Application Laid-Open No. 2005-242373 in which the silicone material is dispersed in a particle form in the charge transport layer, potential fluctuation caused by the above-mentioned factor may be produced due to the same surface migration properties (interface migration properties) as those above.

SUMMARY OF THE INVENTION

An object of the present invention is to provide an electrophotographic photosensitive member that can continuously demonstrate an effect of relaxing contact stress when the electrophotographic photosensitive member contacts a contacting member and the like, and also has excellent potential stability when the electrophotographic photosensitive member is repeatedly used, and a process cartridge and an electrophotographic apparatus which have the electrophotographic photosensitive member.

The present invention provides an electrophotographic photosensitive member having a support, a charge generation layer provided on the support, and a charge transport layer provided on the charge generation layer, the charge transport layer being a surface layer of the electrophotographic photosensitive member, wherein the charge transport layer contains: a charge transporting material, a polyester resin A having a repeating structural unit represented by the following formula (1) and a repeating structural unit represented by the following formula (2), and, at least one of a polyester resin C having a repeating structural unit represented by the following formula (C) and a polycarbonate resin D having a repeating structural unit represented by the following formula (D); the polyester resin A contains a siloxane moiety in an amount of from 5% by mass or more to 30% by mass or less based on the total mass of the polyester resin A; and the charge transport layer has a matrix-domain structure including a matrix made of the charge transporting material and at least one of the polyester resin C and the polycarbonate resin D, and a domain made of the polyester resin A and formed in the matrix:

(1)

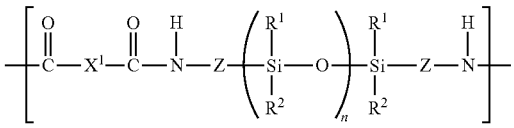

wherein $X^1$ represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom; $R^1$ and $R^2$ each independently represent a substituted or unsubstituted alkyl group, or a substituted or unsubstituted aryl group; Z represents a substituted or unsubstituted alkylene group having from 1 or more to 4 or less carbon atoms; and n represents an average value of the number of repetition of the structure in parenthesis, and is from 20 or more to 200 or less;

(2)

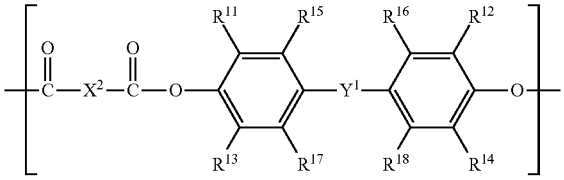

wherein $R^{11}$ to $R^{18}$ each independently represent a hydrogen atom or a substituted or unsubstituted alkyl group; $X^2$ represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom; and $Y^1$ represents a single bond, a substituted or unsubstituted alkylene group, a substituted or unsubstituted arylene group or an oxygen atom;

(C)

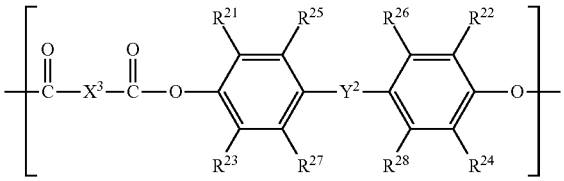

wherein $R^{21}$ to $R^{28}$ each independently represent a hydrogen atom or a substituted or unsubstituted alkyl group; $X^3$ represents a substituted or unsubstituted alkylene group, a substituted or unsubstituted arylene group, a substituted or unsubstituted biphenylene group, or a divalent group in which a plurality of phenylene groups are bonded through an alkylene group or an oxygen atom; and $Y^2$ represents a single bond, a substituted or unsubstituted alkylene group or an oxygen atom;

(D)

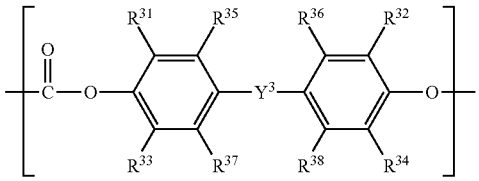

wherein $R^{31}$ to $R^{38}$ each independently represent a hydrogen atom or a substituted or unsubstituted alkyl group; and $Y^3$ represents a single bond, a substituted or unsubstituted alkylene group or an oxygen atom.

The present invention also provides a process cartridge having and integrally supporting the above-mentioned electrophotographic photosensitive member and at least one device selected from the group consisting of a charging device, a developing device, a transfer device and a cleaning device, the process cartridge being detachably provided in a main body of an electrophotographic apparatus.

The present invention also provides an electrophotographic apparatus having the electrophotographic photosensitive member, a charging device, an exposure device, a developing device and a transfer device.

According to the present invention, an electrophotographic photosensitive member that can continuously demonstrate an effect of relaxing contact stress when the electrophotographic photosensitive member is brought into contact with a contacting member and the like, and also has excellent potential stability when the electrophotographic photosensitive member is repeatedly used, and a process cartridge and an electrophotographic apparatus which have the electrophotographic photosensitive member can be provided.

Further features of the present invention will become apparent from the following description of exemplary embodiments with reference to the attached drawings.

BRIEF DESCRIPTION OF THE DRAWINGS

The single FIGURE is a schematic diagram illustrating an example of a configuration of an electrophotographic apparatus provided with a process cartridge having an electrophotographic photosensitive member according to the present invention.

DESCRIPTION OF THE EMBODIMENTS

Preferred embodiments of the present invention will now be described in detail in accordance with the accompanying drawings.

As mentioned above, the electrophotographic photosensitive member according to the present invention is an electrophotographic photosensitive member having a support, a charge generation layer provided on the support, and a charge transport layer provided on the charge generation layer and containing a charge transporting material and a binder resin, the charge transport layer being a surface layer. The charge transport layer contains a charge transporting material, and, as the binder resin, a polyester resin A having a repeating structural unit represented by the following formula (1) and a repeating structural unit represented by the following formula (2) and at least one of a polyester resin C having a repeating structural unit represented by the following formula (C) and a polycarbonate resin D having a repeating structural unit represented by the following formula (D); and the polyester resin A contains a siloxane moiety in an amount of from 5% by mass or more to 30% by mass or less based on the total mass of the polyester resin A; and the charge transport layer has a matrix-domain structure having a matrix made of the charge transporting material and at least one of the polyester resin C and the polycarbonate resin D, and a domain made of the polyester resin A and formed in the matrix:

(1)

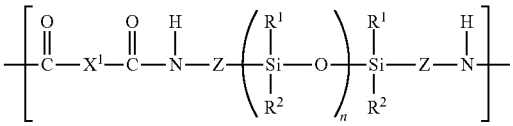

wherein $X^1$ represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom; $R^1$ and $R^2$ each independently represent a substituted or unsubstituted alkyl group, or a substituted or unsubstituted aryl group; Z represents a substituted or unsubstituted alkylene group having from 1 or more to 4 or less carbon atoms; and n represents an average value of the number of repetition of the structure in the parenthesis, and is from 20 or more to 200 or less;

(2)

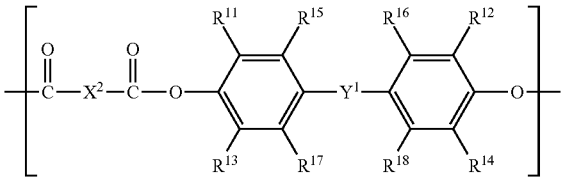

wherein $R^{11}$ to $R^{18}$ each independently represent a hydrogen atom or a substituted or unsubstituted alkyl group; $X^2$ represents a substituted or unsubstituted alkylene group, a substituted or unsubstituted arylene group, a substituted or unsubstituted biphenylene group, or a divalent group to which a plurality of phenylene groups are bonded together through an alkylene group or an oxygen atom; and $Y^1$ represents a single bond, a substituted or unsubstituted alkylene group, a substituted or unsubstituted arylene group, or an oxygen atom;

(C)

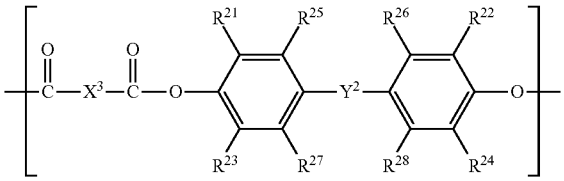

wherein $R^{21}$ to $R^{28}$ each independently represent a hydrogen atom or a substituted or unsubstituted alkyl group; $X^3$ represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom; and $Y^2$ represents a single bond, a substituted or unsubstituted alkylene group or an oxygen atom;

(D)

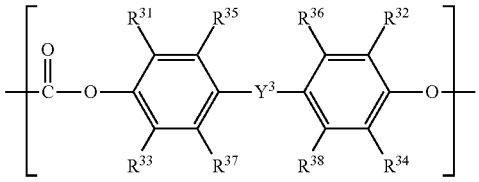

wherein $R^{31}$ to $R^{38}$ each independently represent a hydrogen atom or a substituted or unsubstituted alkyl group; and $Y^3$ represents a single bond, a substituted or unsubstituted alkylene group or an oxygen atom.

$X^1$ in the above formula (1) represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom. Of these, the substituted or unsubstituted arylene group, and the divalent group in which a plurality of phenylene groups are bonded together through an alkylene group or an oxygen atom are preferable. Examples of the alkylene group include an alkylene group having 4 to 8 carbon atoms. Furthermore, the alkylene group may preferably be a butylene group, a hexylene group or an octylene group. Examples of the arylene group include a phenylene group (o-phenylene group, m-phenylene group, p-phenylene group) and a naphthylene group. Of these, the m-phenylene group and the p-phenylene group are preferable. Use of phenylene groups in combination is more preferable than use of only one phenylene group. The ratio (molar ratio) of the m-phenylene group and the p-phenylene group is preferably 1:9 to 9:1, and more preferably 3:7 to 7:3. Examples of the phenylene group in the divalent group in which a plurality of phenylene groups are bonded together through an alkylene group, an oxygen atom or a sulfur atom include an o-phenylene group, an m-phenylene group and a p-phenylene group. Of these, the p-phenylene group is preferable. The alkylene group through which a plurality of phenylene groups are bonded may preferably be a substituted or unsubstituted alkylene group having from 1 or more to 4 or less carbon atoms that form the main chain. Of these, a methylene group is preferable. Examples of the substituent that the above-mentioned respective groups may have include an alkyl group and an aryl group. Examples of the alkyl group include a methyl group, an ethyl group, a propyl group and a butyl group. Examples of the aryl group include a phenyl group. Of these, the methyl group is preferable.

$R^1$ and $R^2$ in the above formula (1) each independently represent a substituted or unsubstituted alkyl group or a substituted or unsubstituted aryl group. Examples of the alkyl group include a methyl group and an ethyl group. Examples of the aryl group include a phenyl group. Of these, $R^1$ and $R^2$ are preferably the methyl group from the viewpoint of relaxation of the contact stress.

In the above formula (1), Z represents a substituted or unsubstituted alkylene group having from 1 or more to 4 or less carbon atoms. Examples of the alkylene group having from 1 or more to 4 or less carbon atoms include a methylene group, an ethylene group, a propylene group and a butylene group. Of these, the propylene group is preferable from the viewpoint of compatibility of the polyester resin A with the charge transporting material (meaning difficulty of phase separation; the same shall apply hereinafter).

In the above formula (1), n represents an average value of the number of repetition of the structure (—$SiR^1R^2$—O—) in the parenthesis, and is from 20 or more to 200 or less. When n is from 20 or more to 200 or less, the domain made of the polyester resin A is efficiently formed in the matrix made of the charge transporting material and one of the polyester resin C and the polycarbonate resin D. Particularly, n may preferably be from 40 or more to 150 or less.

Specific examples of the repeating structural unit represented by the above formula (1) will be shown below:

(1-1)

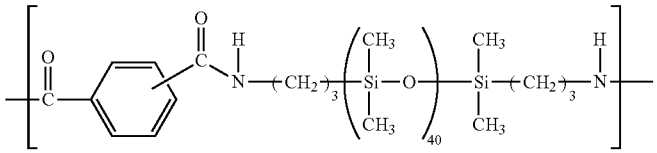

(1-2)

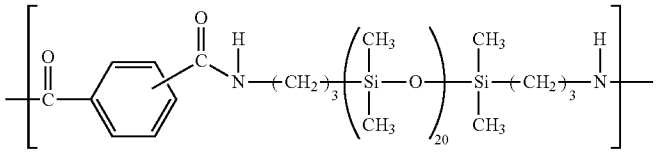

(1-3)

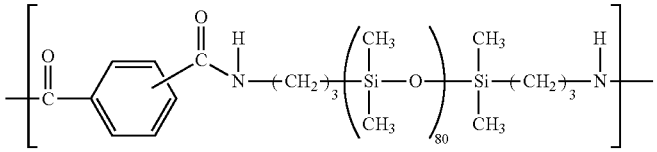

(1-4)

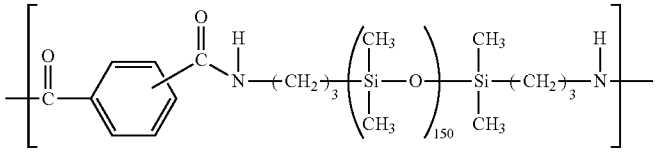

(1-5)

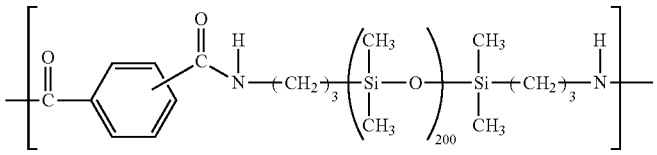

(1-6)

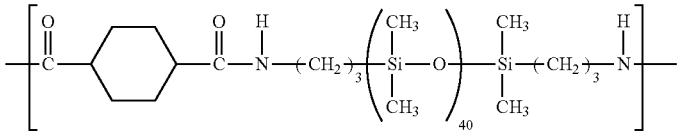

(1-7)

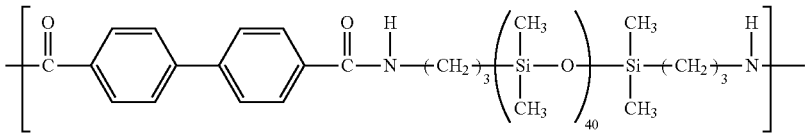

(1-8)

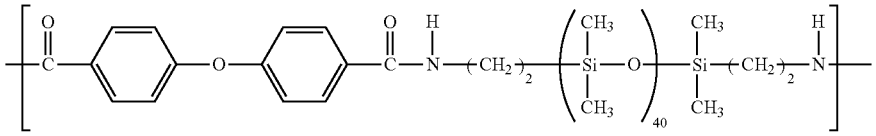

-continued (1-9)

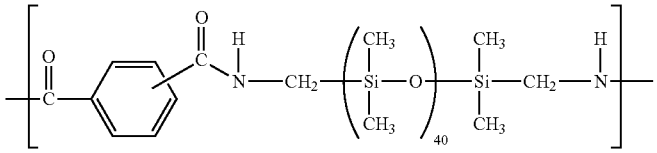

(1-10)

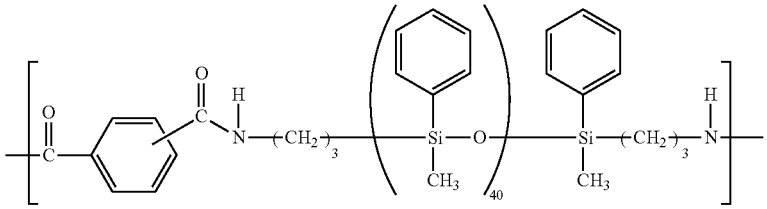

(1-11)

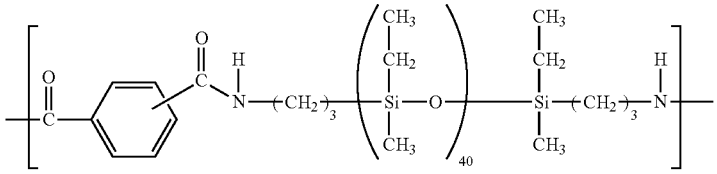

(1-12)

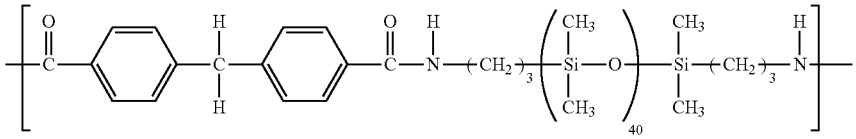

(1-13)

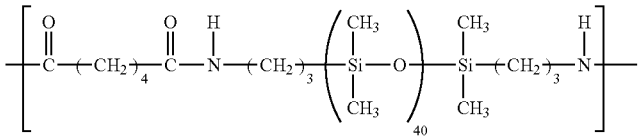

(1-14)

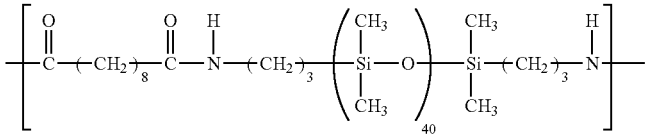

(1-15)

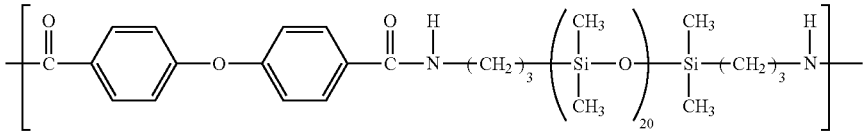

(1-16)

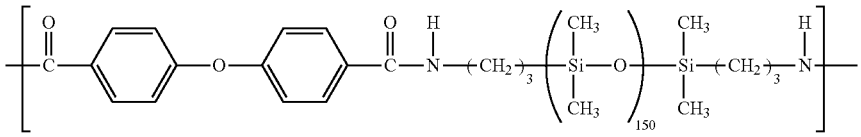

Of these, the repeating structural units represented by the above formulas (1-1), (1-3), (1-4), (1-6), (1-8), (1-15), and (1-16) are preferable.

$R^{11}$ to $R^{18}$ in the above formula (2) each independently represent a hydrogen atom or a substituted or unsubstituted alkyl group. Examples of the alkyl group include a methyl group, an ethyl group, a propyl group and a butyl group. Of these, the methyl group is preferable.

$X^2$ in the above formula (2) represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom. Of these, the substituted or unsubstituted arylene group and the divalent group in which a plurality of phenylene groups are bonded together through an alkylene group or an oxygen atom are preferable. Examples of the alkylene group include an alkylene group having 4 to 8 carbon atoms. Furthermore, the alkylene group may preferably be a butylene group, a hexylene group or an octylene group.

Examples of the arylene group include a phenylene group (o-phenylene group, m-phenylene group, p-phenylene group) and a naphthylene group. Of these, the m-phenylene group and the p-phenylene group are preferable. Use in combination is more preferable than use of only one phenylene group. The ratio (molar ratio) of the m-phenylene group and the p-phenylene group is preferably 1:9 to 9:1, and more preferably 3:7 to 7:3. Examples of the phenylene group in the divalent group in which a plurality of phenylene groups are bonded together through an alkylene group, an oxygen atom or a sulfur atom include an o-phenylene group, an m-phenylene group and a p-phenylene group. Of these, the p-phenylene group is preferable. The alkylene group through which a plurality of phenylene groups are bonded may preferably be a substituted or unsubstituted alkylene group having from 1 or more to 4 or less carbon atoms that form the main chain is preferable. Of these, a methylene group is preferable. Examples of the substituent that the above-mentioned respective groups may have include an alkyl group and an aryl group. Examples of the alkyl group include a methyl group, an ethyl group, a propyl group and a butyl group. Examples of the aryl group include a phenyl group. Of these, the methyl group is preferable.

$Y^1$ in the above formula (2) represents a single bond, a substituted or unsubstituted alkylene group, a substituted or unsubstituted arylene group, an oxygen atom or a sulfur atom. The alkylene group may preferably be a methylene group, an ethylene group, a propylene group or a butylene group. Of these, the methylene group is preferable from the viewpoint of mechanical strength. Examples of the substituent that the alkylene group and the arylene group may have include an alkyl group and an aryl group. Moreover, examples thereof may include a group in which the substituents that the alkylene group and the arylene group may have are connected to each other to form a ring structure. Examples of the alkyl group include a methyl group, an ethyl group, a propyl group and a butyl group. Of these, the methyl group is preferable. Examples of the aryl group include a phenyl group. Examples of the group in which the substituents are connected to each other to form a ring structure include a cycloalkylidene group. Specifically, examples thereof include a cyclopentylidene group, a cyclohexylidene group and a cycloheptylidene group. Of these, the cyclohexylidene group is preferable.

Specific examples of the repeating structural unit represented by the above formula (2) will be shown below:

(2-1)

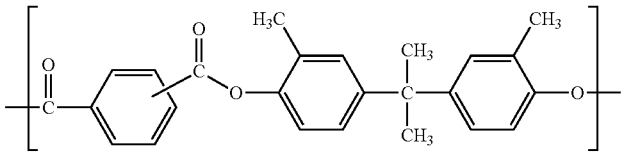

(2-2)

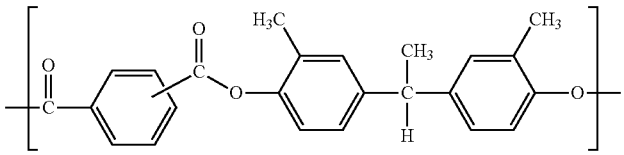

(2-3)

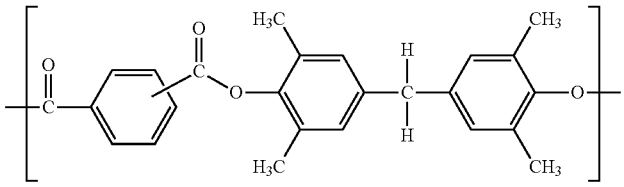

(2-4)

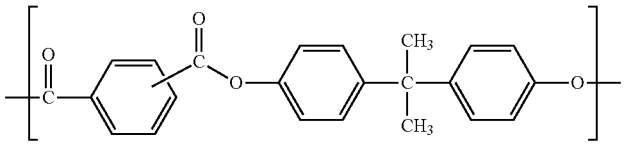

(2-5)

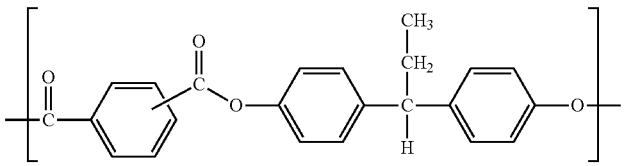

-continued
(2-6)
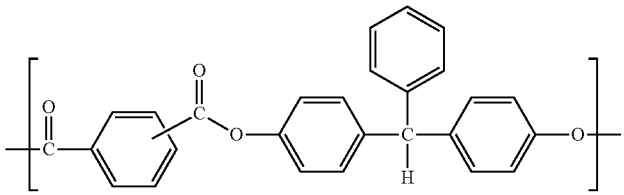
(2-7)
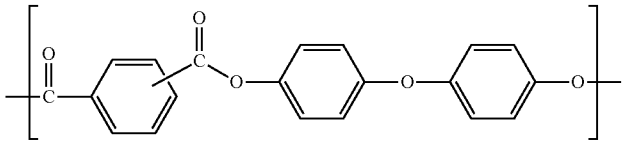
(2-8)
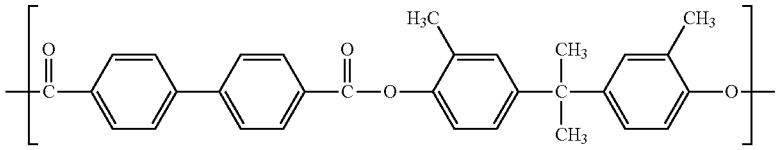
(2-9)
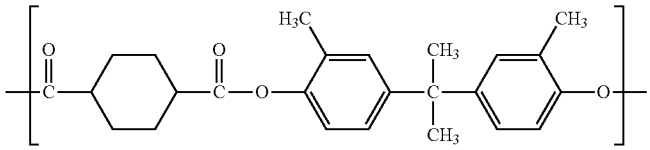
(2-10)
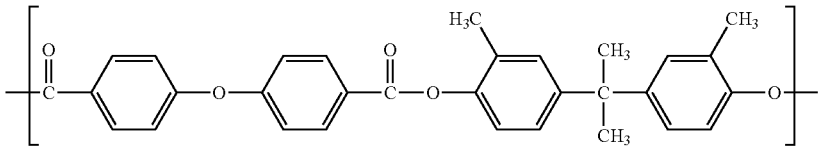
(2-11)
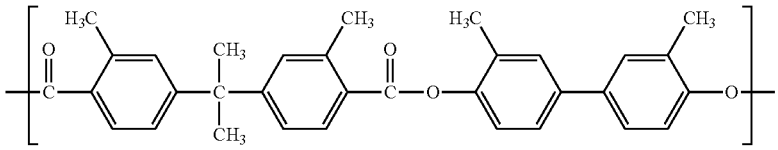
(2-12)
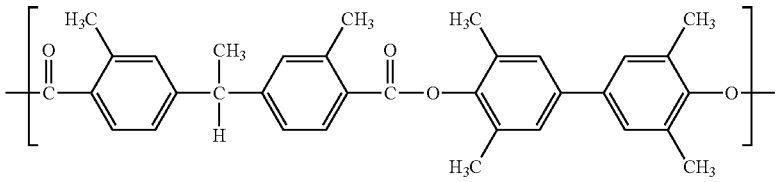
(2-13)
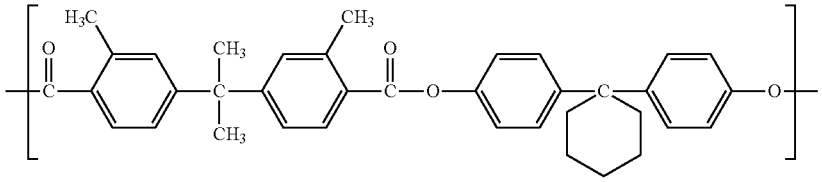
(2-14)
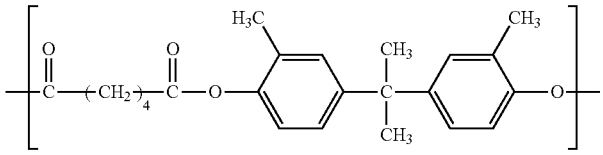

-continued (2-15)

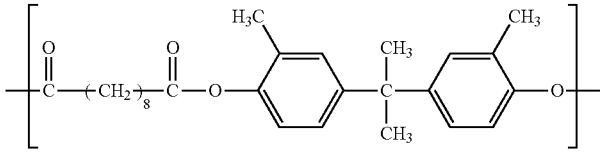

(2-16)

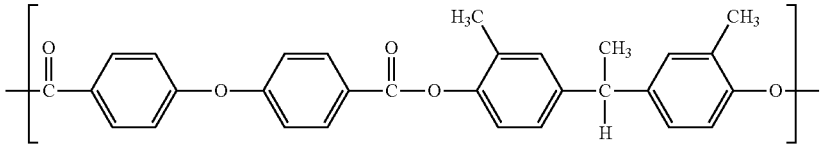

(2-17)

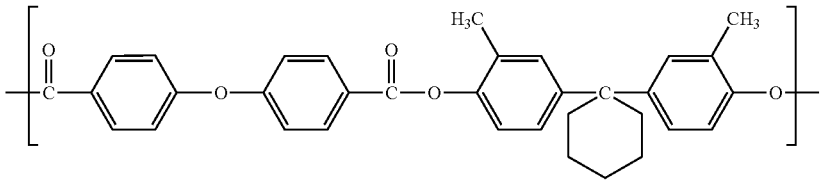

Of these, the repeating structural units represented by the above formulas (2-1), (2-2), (2-9), (2-10), (2-16), and (2-17) are preferable.

The polyester resin A in the present invention also contains a siloxane moiety in a proportion of from 5% by mass or more to 30% by mass or less based on the total mass of the polyester resin A.

In the present invention, the siloxane moiety is a moiety including silicon atoms at both terminals that form the siloxane portion and a group bonded to the silicon atoms, and an oxygen atom interposed between the silicon atoms at the terminals, a silicon atom, and a group bonded to the silicon atom.

Specifically, in the present invention, the siloxane moiety is a moiety represented by the following formula:

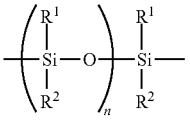

In the above formula, $R^1$, $R^2$ and n have the same meaning as defined for $R^1$, $R^2$ and n in the above formula (1), respectively. To be specific, $R^1$ and $R^2$ each independently represent a substituted or unsubstituted alkyl group or a substituted or unsubstituted aryl group. n represents an average value of the number of repetition of the structure in the parenthesis, and is from 20 or more to 200 or less.

More specifically, in the present invention, the siloxane moiety is a moiety surrounded with the following dashed line, for example, in the case of the repeating structural unit represented by the following formula (1-S):

(1-S)

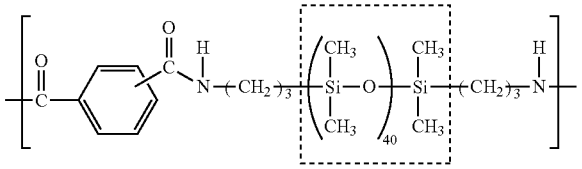

When the siloxane moiety is in a content of 5% by mass or more based on the total mass of the polyester resin A of the present invention, the effect of relaxing the contact stress is continuously demonstrated, and the domain is efficiently formed in the matrix made of the charge transporting material and one of the polyester resin C and the polycarbonate resin D. When the siloxane moiety is in a content of 30% by mass or less, the charge transporting material is prevented from forming an aggregate in the domain made of the polyester resin A so that potential fluctuation is controlled.

The content of the siloxane moiety based on the total mass of the polyester resin A of the present invention can be analyzed by an ordinary analytical method. Hereinafter, an example of the analytical method will be shown.

The charge transport layer, which is the surface layer of the electrophotographic photosensitive member, is dissolved with a solvent. Subsequently, various materials contained in the charge transport layer which is the surface layer are fractionated by a fractionating apparatus such as size exclusion chromatography and high speed liquid chromatography that can separate and recover each composition component. The fractionated polyester resin A is hydrolyzed in the presence of an alkali or the like to be decomposed into a carboxylate portion and a bisphenol portion. With respect to the obtained bisphenol portion, the number of repetition of the siloxane moiety and the molar ratio thereof are calculated by using a nuclear magnetic resonance spectrum analysis or mass spectrometry followed by converting in terms of a content (mass ratio).

The polyester resin A used in the present invention is a copolymer of the repeating structural unit represented by the above formula (1) and the repeating structural unit represented by the above formula (2), and the form of the copolymerization may be any of block copolymerization, random copolymerization, and alternating copolymerization.

The weight average molecular weight of the polyester resin A used in the present invention is preferably from 30,000 or more to 200,000 or less from the viewpoint of forming the domain in the matrix made of the charge transporting material and one of the polyester resin C and the polycarbonate resin D. The weight average molecular weight is more preferably from 40,000 or more to 150,000 or less.

In the present invention, the weight average molecular weight of a resin is a weight average molecular weight in terms of polystyrene measured by the method described in Japanese Patent Application Laid-Open No. 2007-79555 according to a conventional method.

The copolymerization ratio of the polyester resin A used for the present invention can be confirmed by a converting method using a peak area ratio of a hydrogen atom (hydrogen atom that constitutes the resin) according to $^1$H-NMR measurement of the resin, which is an ordinary method.

The polyester resin A used for the present invention can be synthesized by a transesterification method using a dicarboxylic acid ester with a diol compound, for example. The polyester resin A can also be synthesized by a polymerization reaction of a divalent acid halide such as dicarboxylic acid halide with a diol compound.

Next, the polyester resin C having the repeating structural unit represented by the above formula (C) will be described.

$R^{21}$ to $R^{28}$ in the above formula (C) each independently represent a hydrogen atom or a substituted or unsubstituted alkyl group. Examples of the alkyl group include a methyl group, an ethyl group, a propyl group and a butyl group. Of these, the methyl group is preferable.

$X^3$ in the above formula (C) represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom. Of these, the substituted or unsubstituted arylene group, and the divalent group in which a plurality of phenylene groups are bonded together through an alkylene group or an oxygen atom are preferable. Examples of the alkylene group include an alkylene group having 4 to 8 carbon atoms. Furthermore, the alkylene group is preferably a butylene group, a hexylene group and an octylene group. Examples of the arylene group include a phenylene group (o-phenylene group, m-phenylene group, p-phenylene group) and a naphthylene group. Of these, the m-phenylene group and the p-phenylene group are preferable. Use in combination is more preferable than use of only one phenylene group. The ratio (molar ratio) of the m-phenylene group and the p-phenylene group is preferably 1:9 to 9:1, and more preferably 3:7 to 7:3. Examples of the phenylene group in the divalent group in which a plurality of phenylene groups are bonded together through an alkylene group, an oxygen atom or a sulfur atom include an o-phenylene group, an m-phenylene group and a p-phenylene group. Of these, the p-phenylene group is preferable. The alkylene group through which a plurality of phenylene groups are bonded may preferably be a substituted or unsubstituted alkylene group having from 1 or more to 4 or less carbon atoms that form the main chain is preferable. Of these, a methylene group is preferable. Examples of the substituent that the above-mentioned respective groups may have include an alkyl group and an aryl group. Examples of the alkyl group include a methyl group, an ethyl group, a propyl group and a butyl group. Examples of the aryl group include a phenyl group. Of these, the methyl group is preferable.

$Y^2$ in the above formula (C) represents a single bond, a substituted or unsubstituted alkylene group or an oxygen atom. The alkylene group may preferably be a methylene group, an ethylene group, a propylene group or a butylene group. Of these, the methylene group is preferable from the viewpoint of mechanical strength. Examples of the substituent that the alkylene group may have include an alkyl group and an aryl group. Examples thereof may also include a group in which the substituents that the alkylene group may have are connected to each other to form a ring structure. Examples of the alkyl group include a methyl group, an ethyl group, a propyl group and a butyl group. Of these, the methyl group is preferable. Examples of the aryl group include a phenyl group. Examples of the group in which the substituents are connected to each other to form a ring structure include a cycloalkylidene group, and specifically include a cyclopentylidene group, a cyclohexylidene group and a cycloheptylidene group. Of these, the cyclohexylidene group is preferable.

Specific examples of the repeating structural unit represented by the above formula (C) will be shown below:

(3-1)

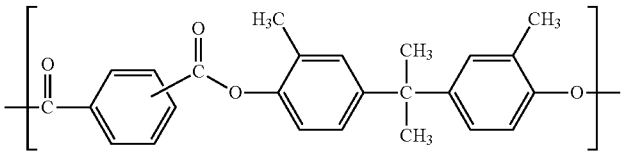

(3-2)

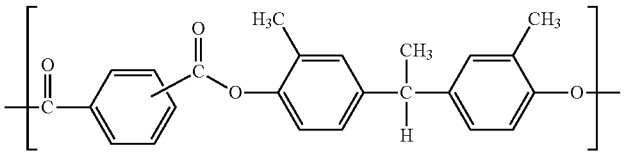

-continued
(3-3)
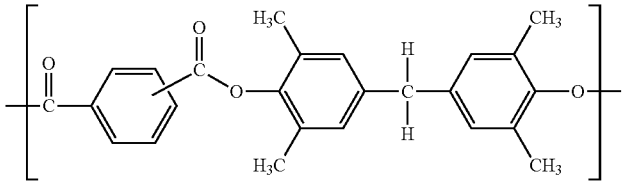
(3-4)
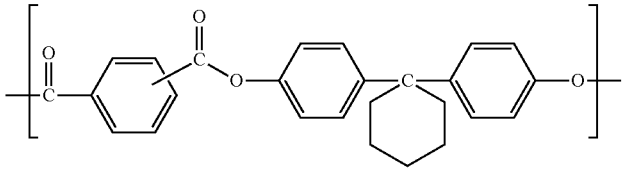
(3-5)
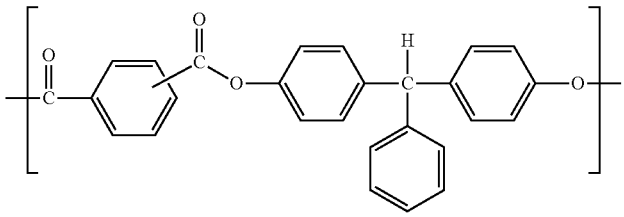
(3-6)
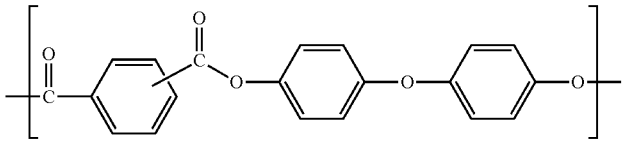
(3-7)
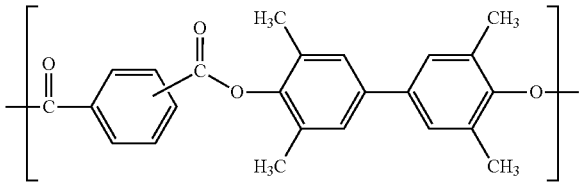
(3-8)
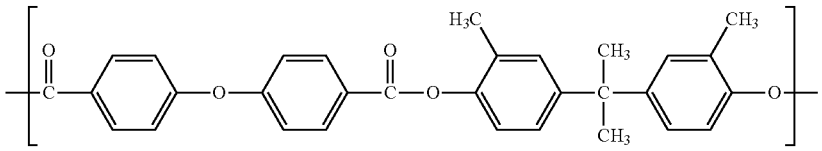
(3-9)
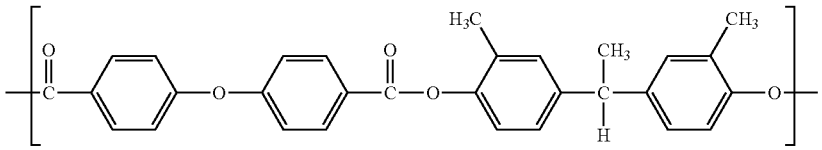
(3-10)
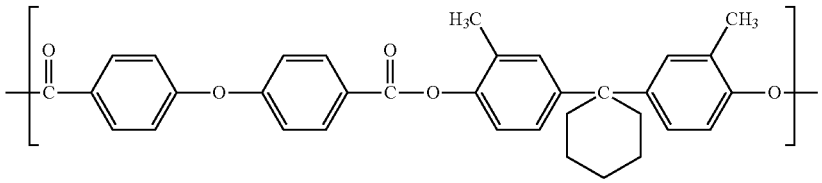

-continued (3-11)

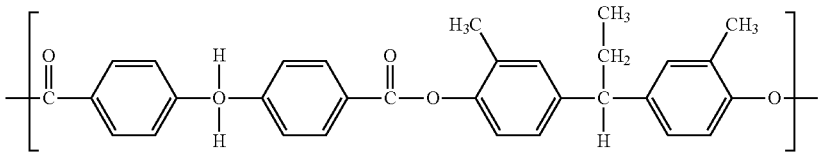

(3-12)

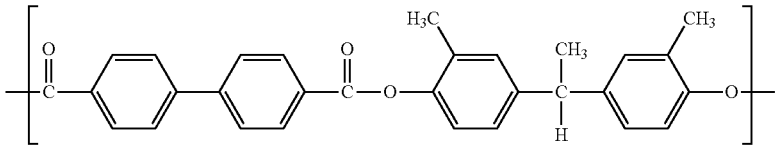

(3-13)

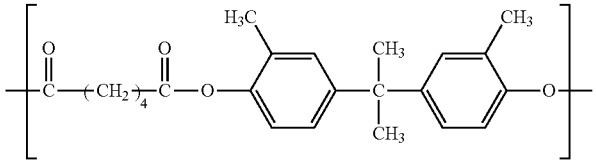

(3-14)

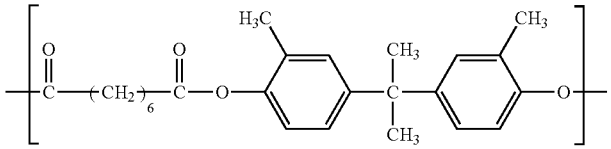

(3-15)

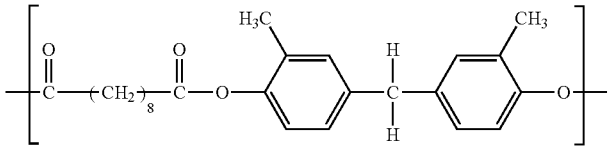

Of these, the groups represented by the above formulas (3-1), (3-2), (3-3), (3-6), (3-7), (3-8), and (3-9) are preferable.

Next, the polycarbonate resin D having the repeating structural unit represented by the above formula (D) will be described.

$R^{31}$ to $R^{38}$ in the above formula (D) each independently represent a hydrogen atom or a substituted or unsubstituted alkyl group. Examples of the alkyl group include a methyl group, an ethyl group, a propyl group and a butyl group. Of these, the methyl group is preferable.

$Y^3$ in the above formula (D) represents a single bond, a substituted or unsubstituted alkylene group or an oxygen atom. The alkylene group may preferably be a methylene group, an ethylene group, a propylene group or a butylene group. Of these, the methylene group is preferable from the viewpoint of mechanical strength. Examples of the substituent that the alkylene group may have include an alkyl group and an aryl group. Examples thereof may also include a group in which the substituents that the alkylene group may have are connected to each other to form a ring structure. Examples of the alkyl group include a methyl group, an ethyl group, a propyl group and a butyl group. Of these, the methyl group is preferable. Examples of the aryl group include a phenyl group. Examples of the group in which the substituents are connected to each other to form a ring structure include a cycloalkylidene group, and specifically include a cyclopentylidene group, a cyclohexylidene group and a cycloheptylidene group. Of these, the cyclohexylidene group is preferable.

Specific examples of the repeating structural unit represented by the above formula (D) will be shown below:

(4-1)

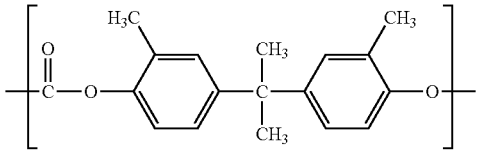

(4-2)

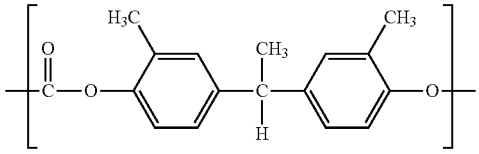

-continued (4-3)

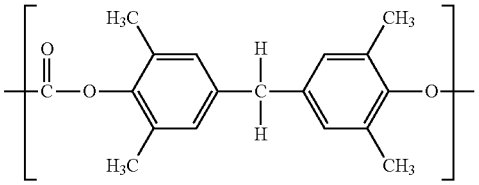

(4-4)

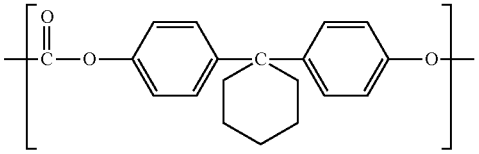

(4-5)

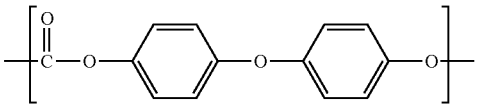

(4-6)

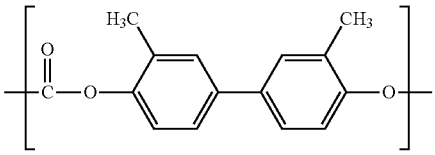

Of these, the repeating structural units represented by the above formulas (4-1), (4-4), and (4-5) are preferable.

The charge transport layer in the present invention has a matrix-domain structure comprising the matrix made of the charge transporting material and at least one of the polyester resin C and the polycarbonate resin D, and the domain made of the polyester resin A and formed in the matrix. In the matrix-domain structure in the present invention, the matrix is equivalent to a sea and the domain is equivalent to an island as a "sea island structure."

The domain made of the polyester resin A shows a granular (island-shaped) structure formed in the matrix made of the charge transporting material and at least one of the polyester resin C and the polycarbonate resin D. In the domain made of the polyester resin A, domains exist independently in the matrix. Such a matrix-domain structure can be recognized by observing the surface of the charge transport layer or observing the cross section thereof.

Observation of the state of the matrix-domain structure or measurement of the domain can be performed using a commercially available laser beam microscope, optical microscope, electron microscope, or atomic force microscope, for example. Using the above microscope, the state of the matrix-domain structure can be observed or the domain can be measured at a predetermined magnification.

The number average particle diameter of the domains made of the polyester resin A in the present invention is preferably from 100 nm or more to 500 nm or less. The particle diameters of the respective domains are preferably in narrower particle diameter distribution from the viewpoint of a coating film and uniformity of the effect of relaxing the stress. The number average particle diameter of the domains in the present invention is calculated by vertically cutting the charge transport layer, arbitrarily selecting 100 domains out of the domains observed by the microscope examination of the cross section thus cut and equalizing largest particle diameters of the cut domains.

In order to form the matrix-domain structure in the present invention, the content of the siloxane moiety in the polyester resin A is preferably from 1% by mass or more to 20% by mass or less based on the total mass of all the resins (all the binder resins) in the charge transport layer. Additionally, also from the viewpoint of achieving a good balance between the relaxation of the contact stress and the potential stability during repetitive use of the electrophotographic photosensitive member, the content of the siloxane moiety in the polyester resin A is preferably from 1% by mass or more to 20% by mass or less based on the total mass of all the resins (all the binder resins) in the charge transport layer. Further, the content of the siloxane moiety in the polyester resin A is more preferably from 2% by mass or more to 10% by mass or less, and in this case, the contact stress can be further relaxed and the potential stability during repetitive use of the electrophotographic photosensitive member can be further enhanced.

The matrix-domain structure of the charge transport layer in the electrophotographic photosensitive member according to the present invention can be formed by using a coating liquid for a charge transport layer containing the charge transporting material, the polyester resin A, and at least one of the polyester resin C and the polycarbonate resin D. The matrix-domain structure can also be formed in the case where the charge transport layer is formed using a coating liquid containing the polyester resin A that forms the domain, and only at least one resin of the polyester resin C and the polycarbonate resin D that form the matrix. On the other hand, when the charge transport layer is formed using a coating liquid containing the charge transporting material and the polyester resin A having the siloxane moiety, the charge transporting material may form an aggregate in the polyester resin having the siloxane moiety. The matrix-domain structure in the present invention is in a different state from the formation of an aggregate by the charge transporting material. The electrophotographic photosensitive member according to the present invention including the charge transport layer having the matrix-domain structure can keep stable potential properties, the matrix-domain structure including the matrix made of the charge transporting material and at least one of the polyester resin C and the polycarbonate resin D, and the domain made of the polyester resin A and formed in the matrix. Although a detailed reason is unclear, the present inventors think that it is attributed to the phenomenon shown below.

Namely, the matrix-domain structure of the present invention is a structure in which the polyester resin A (or the siloxane moiety contained in the polyester resin A) forms the domain in the matrix made of the charge transporting material and at least one of the polyester resin C and the polycarbonate resin D. In this case, a favorable charge transport ability can be kept because the matrix is made of the charge transporting material and at least one of the polyester resin C and the polycarbonate resin D. Unless an aggregate of the charge transporting material is recognized in the domain made of the polyester resin A, it is thought that there is no reduction in the charge transport ability due to the aggregation of the charge transporting material. It is also thought that the domain made of the polyester resin A is formed in the charge transport layer so that the effect of relaxing the stress is brought about in a sustained manner.

Further, it is thought that the polyester resin A forming the domain of the matrix-domain structure in the present invention has a cycloalkylene structure so that the domain is easily formed in the matrix of the polyester resin C and the polycarbonate resin D. This is attributed to the fact that the polyester resin A has the cycloalkylene structure while the polyester resin C and the polycarbonate resin D, which form the matrix, have a number of aromatic ring structures. Namely, the polyester resin A tends to easily form the domain because of the cycloalkylene structure having a different compatibility from that of the aromatic ring structure in the matrix.

The charge transporting material is a compound having an aromatic ring structure, and therefore has different compatibility from that of the cycloalkylene structure in the polyester resin A. It is thought that as a result, the charge transporting material contained in the domain is reduced so that there is no reduction in the charge transport ability due to aggregation of the charge transporting material.

Hereinafter, synthesis examples of the polyester resin A used for the present invention will be shown.

Synthesis of Polyester Resin A (1) Having a Repeating Structural Unit Represented by Above Formula (1-1) and a Repeating Structural Unit Represented by Above Formula (2-1)

49.2 g of dicarboxylic acid halide represented by the following formula (5) (mixture of terephthalic acid chloride and isophthalic acid chloride with a molar ratio of 50:50):

(5)

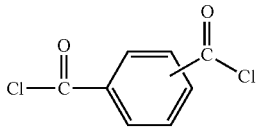

was dissolved in dichloromethane to prepare an acid halide solution. Separately of the acid halide solution, 21.7 g of organosiloxane represented by the following formula (6):

(6)

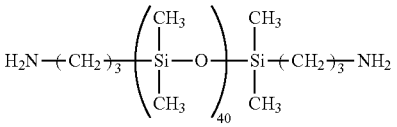

and 43.9 g of diol represented by the following formula (7):

(7)

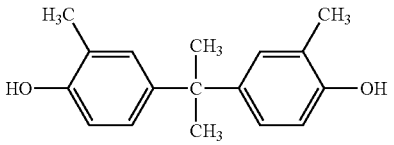

were dissolved in a 10% aqueous solution of sodium hydroxide. Tributyl benzyl ammonium chloride was added as a polymerization catalyst to the solution, and the solution was stirred to prepare a diol compound solution.

Next, polymerization was started by adding the acid halide solution to the diol compound solution while stirring the solution. The polymerization was performed for 3 hours while keeping the reaction temperature within 25° C. and stirring the solution.

Subsequently, acetic acid was added to terminate the polymerization reaction, and washing with water was repeated until an aqueous phase reached neutrality. After washing, the polymerization solution was dropped to methanol under stirring to precipitate a polymerization product. This polymerization product was dried in a vacuum to obtain 80 g of the polyester resin A (1) having the repeating structural unit represented by the above formula (1-1) and the repeating structural unit represented by the above formula (2-1). The polyester resin A (1) is shown in Table 1. The content of the siloxane moiety in the polyester resin A (1) was found to be 20% by mass according to the calculation as mentioned above. The weight average molecular weight of the polyester resin A (1) was 60,000. These values are shown in Table 1.

The polyester resins A shown in Table 1 were produced using the synthesis method shown in the above synthesis example of the polyester resin A.

TABLE 1

| | Polyester resin A | Repeating structural unit represented by formula (1) | m-phenylene/p-phenylene ratio | Repeating structural unit represented by formula (2) | m-phenylene/p-phenylene ratio | Content of siloxane moiety in polyester resin (% by mass) | Weight average molecular weight (Mw) |
|---|---|---|---|---|---|---|---|
| Synthesis example 1 | Polyester resin A (1) | (1-1) | 5/5 | (2-1) | 5/5 | 20 | 60,000 |
| Synthesis example 2 | Polyester resin A (2) | (1-1) | 5/5 | (2-1) | 5/5 | 20 | 120,000 |
| Synthesis example 3 | Polyester resin A (3) | (1-1) | 5/5 | (2-1) | 5/5 | 20 | 150,000 |
| Synthesis example 4 | Polyester resin A (4) | (1-1) | 5/5 | (2-7) | 5/5 | 20 | 60,000 |
| Synthesis example 5 | Polyester resin A (5) | (1-1) | 5/5 | (2-12) | — | 20 | 40,000 |
| Synthesis example 6 | Polyester resin A (6) | (1-1) | 5/5 | (2-2) | 5/5 | 10 | 60,000 |
| Synthesis example 7 | Polyester resin A (7) | (1-1) | 5/5 | (2-2) | 5/5 | 30 | 60,000 |
| Synthesis example 8 | Polyester resin A (8) | (1-1) | 5/5 | (2-2) | 5/5 | 30 | 40,000 |
| Synthesis example 9 | Polyester resin A (9) | (1-2) | 5/5 | (2-1) | 5/5 | 20 | 60,000 |
| Synthesis example 10 | Polyester resin A (10) | (1-2) | 5/5 | (2-1) | 5/5 | 30 | 60,000 |
| Synthesis example 11 | Polyester resin A (11) | (1-3) | 5/5 | (2-3) | 5/5 | 30 | 80,000 |

TABLE 1-continued

| | Polyester resin A | Repeating structural unit represented by formula (1) | m-phenylene/p-phenylene ratio | Repeating structural unit represented by formula (2) | m-phenylene/p-phenylene ratio | Content of siloxane moiety in polyester resin (% by mass) | Weight average molecular weight (Mw) |
|---|---|---|---|---|---|---|---|
| Synthesis example 12 | Polyester resin A (12) | (1-4) | 5/5 | (2-1) | 5/5 | 20 | 60,000 |
| Synthesis example 13 | Polyester resin A (13) | (1-4) | 5/5 | (2-1) | 5/5 | 10 | 100,000 |
| Synthesis example 14 | Polyester resin A (14) | (1-5) | 5/5 | (2-4) | 5/5 | 10 | 60,000 |
| Synthesis example 15 | Polyester resin A (15) | (1-5) | 5/5 | (2-4) | 5/5 | 5 | 180,000 |
| Synthesis example 16 | Polyester resin A (16) | (1-6) | — | (2-5) | 5-5 | 5 | 30,000 |
| Synthesis example 17 | Polyester resin A (17) | (1-7) | — | (2-8) | — | 20 | 60,000 |
| Synthesis example 18 | Polyester resin A (18) | (1-8) | — | (2-9) | — | 20 | 60,000 |
| Synthesis example 19 | Polyester resin A (19) | (1-9) | 5/5 | (2-10) | — | 20 | 60,000 |
| Synthesis example 20 | Polyester resin A (20) | (1-1) | 7/3 | (2-1) | 7-3 | 20 | 60,000 |
| Synthesis example 21 | Polyester resin A (21) | (1-12) | — | (2-11) | — | 20 | 40,000 |
| Synthesis example 22 | Polyester resin A (22) | (1-14) | — | (2-12) | — | 30 | 60,000 |
| Synthesis example 23 | Polyester resin A (23) | (1-15) | — | (2-16) | — | 20 | 60,000 |
| Synthesis example 24 | Polyester resin A (24) | (1-16) | — | (2-17) | — | 20 | 60,000 |

The charge transport layer, which is the surface layer of the electrophotographic photosensitive member according to the present invention, contains the polyester resin A and at least one of the polyester resin C and the polycarbonate resin D, and may additionally contain another resin. Examples of the resin that may be additionally mixed include acrylic resins, polyester resins, and polycarbonate resins.

From the viewpoint of efficient formation of the above matrix-domain structure, the polyester resin C and the polycarbonate resin D may preferably have no repeating structural unit represented by the above formula (1).

Examples of the charge transporting material contained in the charge transport layer, which is the surface layer of the electrophotographic photosensitive member according to the present invention, include triarylamine compounds, hydrazone compounds, styryl compounds, and stilbene compounds. One of these charge transporting materials may be used, or two or more thereof may be used. Of these, use of the triarylamine compounds as the charge transporting material is preferable from the viewpoint of improvement in electrophotographic properties.

Next, a configuration of the electrophotographic photosensitive member according to the present invention will be described.

The electrophotographic photosensitive member according to the present invention is an electrophotographic photosensitive member including a support, a charge generation layer provided on the support, and a charge transport layer provided on the charge generation layer as mentioned above. The electrophotographic photosensitive member according to the present invention is also an electrophotographic photosensitive member in which the charge transport layer is the surface layer (top layer) of the electrophotographic photosensitive member.

Moreover, the charge transport layer of the electrophotographic photosensitive member according to the present invention contains the charge transporting material. The charge transport layer also contains the polyester resin A and at least one of the polyester resin C and the polycarbonate resin D.

The charge transport layer may also have a laminated layer structure. In that case, the matrix-domain structure is provided at least in the outermost charge transport layer on the surface side. Usually, as the electrophotographic photosensitive member, cylindrical electrophotographic photosensitive members produced by forming a photosensitive layer on a cylindrical support are widely used. The electrophotographic photosensitive member can also have a belt-like shape or a sheet-like shape.

The support may preferably have conductivity (conductive supports), and supports made of a metal such as aluminum, aluminum alloys and stainless steel can be used.

In the case of a support made of aluminum or an aluminum alloy, ED tubes, EI tubes, and those which undergo cutting, electrolytic abrasive polishing (electrolysis with electrodes having electrolytic action and an electrolytic solution, and polishing with a grinding stone having grinding action) and a wet or dry honing process can also be used.

Metal supports and resin supports having a coating layer formed by vacuum deposition of aluminum, an aluminum alloy, or an indium oxide-tin oxide alloy can also be used.

Supports obtained by impregnating a resin or the like with conductive particles such as carbon black, tin oxide particles, titanium oxide particles, and silver particles, and plastics containing a conductive binder resin can also be used.

The surface of the support may be subjected to cutting treatment, surface roughening treatment, alumite treatment or the like in order to prevent interference fringes caused by scattering of laser beams or the like.

In the case where the surface of the support is a layer provided in order to give conductivity, the layer may have a volume resistivity of preferably $1\times10^{10}$ Ω·cm or less, and more preferably $1\times10^{6}$ Ω·cm or less.

Between the support and an intermediate layer mentioned below or the charge generation layer, a conductive layer may be provided in order to prevent interference fringes caused by scattering of laser beams or the like and in order to cover scratches on the support. This is a layer formed by using a coating liquid for a conductive layer in which conductive particles are dispersed in a binder resin.

Examples of the conductive particles include powders of carbon black or acetylene black, powders of a metal such as aluminum, nickel, iron, nichrome, copper, zinc or silver, and powders of a metal oxide such as conductive tin oxide or ITO.

Examples of the binder resin include polyester resins, polycarbonate resins, polyvinyl butyral, acrylic resins, silicone resins, epoxy resins, melamine resins, urethane resins, phenol resins and alkyd resins.

Examples of a solvent used for the coating liquid for a conductive layer include ether solvents, alcohol solvents, ketone solvents and aromatic hydrocarbon solvents.

The thickness of the conductive layer is preferably from 0.2 μm or more to 40 μm or less, more preferably from 1 μm or more to 35 μm or less, and still more preferably from 5 μm or more to 30 μm or less.

In the conductive layer having dispersed conductive particles or resistance regulating particles, the surface thereof tends to be roughened.

Between the support or the conductive layer and the charge generation layer, an intermediate layer having barrier function and adhesion function may be provided. The intermediate layer is formed for improvement in adhesiveness of a photosensitive layer, coating properties and injection of charges from the support, and protection against electrical breakdown of the photosensitive layer, for example.

The intermediate layer can be formed by applying a coating liquid for an intermediate layer containing the binder resin onto the conductive layer, and drying or curing the coating liquid.

Examples of the binder resin for the intermediate layer include polyacrylic acids, methylcellulose, ethylcellulose, polyamide resins, polyimide resins, polyamide-imide resins, polyamide acid resins, melamine resins, epoxy resins and polyurethane resins.

The binder resin for the intermediate layer may preferably be a thermoplastic resin from the viewpoint of effective manifestation of electrical barrier properties in the intermediate layer, and from the viewpoint of suitable realization of coating properties, adhesion, solvent resistance and electric resistance. Specifically, the binder resin for the intermediate layer may preferably be thermoplastic polyamide resins. Such a polyamide resin may preferably be low-crystalline or non-crystalline copolymerized nylons that can be applied in a solution state.

The thickness of the intermediate layer is preferably from 0.05 μm or more to 7 μm or less, and more preferably from 0.1 μm or more to 2 μm or less.

Additionally, in order to prevent flow of charges (carriers) from stagnating in the intermediate layer, the intermediate layer may also contain semi-conductive particles or an electron transporting material (electron receptive material as an acceptor).

The charge generation layer is provided on the support, the conductive layer or the intermediate layer.

Examples of the charge generating material used for the electrophotographic photosensitive member according to the present invention include azo pigments, phthalocyanine pigments, indigo pigments and perylene pigments. One kind of charge generating material may be used, or two or more kinds of thereof may be used. Of these, particularly metal phthalocyanines such as oxytitanium phthalocyanine, hydroxygallium phthalocyanine, and chlorogallium phthalocyanine are preferable in terms of the high sensitivity.

Examples of the binder resins used for the charge generation layer include polycarbonate resins, polyester resins, butyral resins, polyvinyl acetal resins, acrylic resins, vinyl acetate resins and urea resins. Of these, the butyral resins are particularly preferable. One kind of the binder resin can be used, or two or more kinds of the binder resins can be used alone or in combination, or as a copolymer thereof.

The charge generation layer can be formed by applying a coating liquid for a charge generation layer obtained by dispersing the charge generating material together with the binder resin and a solvent, and drying the coating liquid. The charge generation layer may also be a vapor deposition film made of the charge generating material.

Examples of dispersion methods include methods using a homogenizer, ultrasonic waves, a ball mill, a sand mill, an attritor, and a roll mill.

The proportion of the charge generating material and the binder resin is preferably within the range of 1:10 to 10:1 (mass ratio), and particularly more preferably within the range of 1:1 to 3:1 (mass ratio).

The solvent used for the coating liquid for a charge generation layer is selected according to solubility and dispersion stability of the binder resin and the charge generating material to be used. Examples of organic solvents include alcohol solvents, sulfoxide solvents, ketone solvents, ether solvents, ester solvents, and aromatic hydrocarbon solvents.

The thickness of the charge generation layer is preferably 5 μm or less, and more preferably from 0.1 μm or more to 2 μm or less.

Moreover, various sensitizers, antioxidants, ultraviolet absorbing agents, plasticizers and the like can also be added to the charge generation layer when necessary. Additionally, in order to prevent flow of charges (carriers) from stagnating in the charge generation layer, the charge generation layer may also contain an electron transport material (electron receptive material such as an acceptor).

The charge transport layer is provided on the charge generation layer.

Examples of the charge transporting material used for the electrophotographic photosensitive member according to the present invention include triarylamine compounds, hydrazone compounds, styryl compounds, and stilbene compounds.

The charge transport layer, which is the surface layer of the electrophotographic photosensitive member according to the present invention, contains the polyester resin A and at least one of the polyester resin C and the polycarbonate resin D. However, as mentioned above, another resin may further be mixed and used. The another resin that may be mixed and used is as mentioned above.

The charge transport layer can be formed by applying a coating liquid for a charge transport layer obtained by dissolving the charge transporting material and the respective resins in a solvent, and drying the coating liquid. The proportion of the charge transporting material and the binder resin is preferably within the range of 4:10 to 20:10 (mass ratio), and more preferably within the range of 5:10 to 12:10 (mass ratio).

Examples of the solvent used for the coating liquid for a charge transport layer include ketone solvents, ester solvents, ether solvents, and aromatic hydrocarbon solvents. While these solvents may be used alone, two or more thereof may be mixed and used. Of these solvents, use of the ether solvents or the aromatic hydrocarbon solvents is preferable from the viewpoint of resin solubility.

The thickness of the charge transport layer is preferably from 5 μm or more to 50 μm or less, and more preferably from 10 μm or more to 35 μm or less.

An antioxidant, an ultraviolet absorbing agent, a plasticizer and the like can also be added to the charge transport layer when necessary.

Various additives can be added to the respective layers of the electrophotographic photosensitive member according to the present invention. Examples of the additives include deterioration preventing agents such as an antioxidant, an ultraviolet absorbing agent and a light stabilizer, and particulates such as organic particulates and inorganic particulates. Examples of the deterioration preventing agent include hindered phenol antioxidants, hindered amine light stabilizers, sulfur atom containing antioxidants, and phosphorus atom containing antioxidants. Examples of the organic particulates include polymer resin particles such as fluorine atom containing resin particles, polystyrene particulates and polyethylene resin particles. Examples of the inorganic particulates include metal oxides such as silica and alumina.

When the coating liquids for the respective layers are applied, a coating method such as a dip coating method, a spray coating method, a spinner coating method, a roller coating method, a Mayer bar coating method, and a blade coating method can be used.

The accompanying FIGURE schematically illustrates an example of a configuration of an electrophotographic apparatus provided with a process cartridge including the electrophotographic photosensitive member according to the present invention.

In the FIGURE, a cylindrical electrophotographic photosensitive member 1 is rotated and driven around an axis 2 in the arrow direction at a predetermined circumferential speed.

The surface of the electrophotographic photosensitive member 1 to be rotated and driven is electrically charged uniformly by means of a charging device 3 (primary charging device: charging roller or the like) so as to have a positive or negative potential of a predetermined level. Next, the surface of the electrophotographic photosensitive member 1 receives exposure light 4 (image exposure light) output from an exposure device (not illustrated) such as slit exposure and laser beam scanning exposure. Thus, an electrostatic latent image corresponding to an objective image is sequentially formed on the surface of the electrophotographic photosensitive member 1.

The electrostatic latent image formed on the surface of the electrophotographic photosensitive member 1 is developed with a toner contained in a developer of a developing device 5 to form a toner image. Next, the toner image formed and carried on the surface of the electrophotographic photosensitive member 1 is sequentially transferred onto a transfer material P (paper or the like) by a transfer bias from a transfer device 6 (transfer roller or the like). Synchronizing with rotation of the electrophotographic photosensitive member 1, the transfer material P is supplied from a transfer material supply device (not illustrated) between the electrophotographic photosensitive member 1 and the transfer device 6 (contacting part), and conveyed.

The transfer material P subjected to the transfer of the toner image is removed from the surface of the electrophotographic photosensitive member 1, and introduced to a fixing device 8 to fix the image. Thereby, the transfer material P is discharged to the outside of the apparatus as an image formed product (printed matter, printed copy).

The surface of the electrophotographic photosensitive member 1 after the toner image is transferred is cleaned by a cleaning device 7 (cleaning blade or the like) by removing the transfer residual developer (toner). Next, the electrophotographic photosensitive member 1 is subjected to charge removal by pre-exposure light (not illustrated) from a pre-exposure device (not illustrated) and subsequently repeatedly used for image formation. As illustrated in the FIGURE, in the case where the charging device 3 is a contact charging device using an electrically charging roller or the like, the pre-exposure is not always necessary.

Of components such as the electrophotographic photosensitive member 1, the charging device 3, the developing device 5, the transfer device 6 and the cleaning device 7, two or more components may be configured such that the components are accommodated in a container and integrally formed as a process cartridge, and this process cartridge is detachably provided in the main body of the electrophotographic apparatus such as copying machines and laser beam printers. The FIGURE illustrates a process cartridge 9 detachably provided in the main body of the electrophotographic apparatus using a guide device 10 such as a rail of the main body of the electrophotographic apparatus, in which the electrophotographic photosensitive member 1, and the charging device 3, the developing device and the cleaning device 7 are included and integrally supported and formed into a cartridge.

Hereinafter, specific Examples will be given to describe the present invention more in detail. However, the present invention will not be limited to these Examples. "Part" in Examples means "part by mass."

EXAMPLE 1

An aluminum cylinder having a diameter of 30 mm and a length of 260.5 mm was used as a support.

Next, a coating liquid for a conductive layer was prepared by using 10 parts of $SnO_2$-coated barium sulfate (conductive particles), 2 parts of titanium oxide (resistance regulating pigment), 6 parts of a phenol resin (binder resin), 0.001 parts of silicone oil (leveling agent), and a mixed solvent of 4 parts of methanol/16 parts of methoxy propanol.

This coating liquid for a conductive layer was applied onto the support by dip coating, and cured (heat cured) at 140° C. for 30 minutes to form a conductive layer having a thickness of 15 μm.

Next, a coating liquid for an intermediate layer was prepared by dissolving 3 parts of N-methoxymethylized nylon and 3 parts of a copolymerized nylon in a mixed solvent of 65 parts of methanol and 30 parts of n-butanol.

This coating liquid for an intermediate layer was applied onto the conductive layer by dip coating, and dried at 100° C. for 10 minutes to form an intermediate layer having a thickness of 0.7 μm.

Next, 10 parts of hydroxygallium phthalocyanine (charge generating material) in a crystal form having strong peaks at 7.5°, 9.9°, 16.3°, 18.6°, 25.1° and 28.3° of a Bragg angle 2θ±0.2° in CuKα characteristic X ray diffraction was added to a liquid in which 5 parts of a polyvinyl butyral resin (trade name: S-LEC BX-1, made by Sekisui Chemical Co., Ltd., binder resin) was dissolved in 250 parts of cyclohexanone. The obtained solution was dispersed under an atmosphere of 23±3° C. for 1 hour by a sand mill apparatus using glass beads having a diameter of 1 mm. After dispersion, 250 parts of ethyl acetate was added to the solution to prepare a coating liquid for a charge generation layer.

This coating liquid for a charge generation layer was applied onto the intermediate layer by dip coating, and dried at 100° C. for 10 minutes to form a charge generation layer having a thickness of 0.26 μm.

Next, 8 parts of the compound (charge transporting material) represented by the following formula (CTM-1):

(CTM-1)

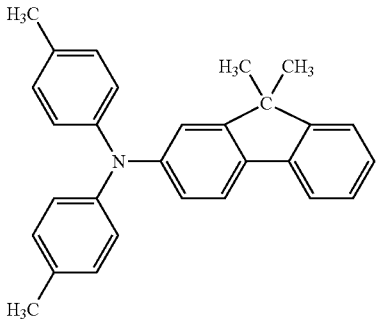

2 parts of the compound represented by the following formula (CTM-2) (charge transporting material):

(CTM-2)

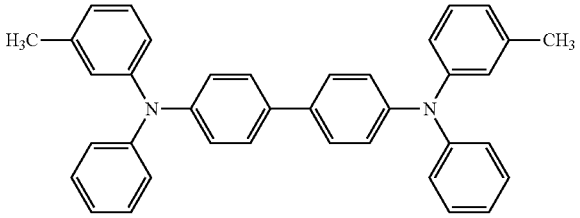

and 3 parts of the polyester resin A(1) synthesized in Synthesis Example 1 and 7 parts of the polyester resin C(1) having the repeating structural unit represented by the above formula (3-1) (a molar ratio of p-phenylene and m-phenylene of 5:5 and a weight average molecular weight of 120,000) as the binder resin were dissolved in a mixed solvent of 20 parts of dimethoxymethane and 60 parts of xylene to prepare a coating liquid for a charge transport layer.

This coating liquid for a charge transport layer was applied onto the charge generation layer by dip coating, and dried at 120° C. for 1 hour to form a charge transport layer having a thickness of 19 μm. It was confirmed that in the formed charge transport layer, the domain made of the polyester resin A(1) was included in the matrix made of the charge transporting material and the polyester resin C(1).

Thus, electrophotographic photosensitive members in which the charge transport layer was the surface layer were produced. Table 2 shows a configuration of the binder resins contained in the charge transport layer and a content of the siloxane moiety in the polyester resin A.

Next, evaluation will be described.

Evaluation was made with respect to fluctuation of light portion potential (potential fluctuation) when the electrophotographic photosensitive member was repeatedly used to reproduce images on 2,000 sheets, a relative value of an initial torque and a relative value of a torque when the electrophotographic photosensitive member was repeatedly used to reproduce images on 2,000 sheets, and observation of the surface of the electrophotographic photosensitive member when the torque was measured.

As an evaluation apparatus, a laser beam printer LBP-2510 made by Canon, Inc. (charging (primary charging): contact charging method, process speed: 94.2 mm/s) was altered for use so that the charging potential (dark portion potential) of the electrophotographic photosensitive member could be controlled. A cleaning blade made of a polyurethane rubber was set at a contact angle of 25° and a contact pressure of 35 g/cm with respect to the surface of the electrophotographic photosensitive member.

Evaluation was performed under an environment of a temperature of 23° C. and a relative humidity of 50%.

<Evaluation of Potential Fluctuation>

An amount of exposure (amount of exposure of an image) of the evaluation apparatus having a laser light source of 780 nm was set so that an amount of light on the surface of the electrophotographic photosensitive member might be 0.3 $\mu J/cm^2$. The surface potential (dark portion potential and light portion potential) of the electrophotographic photosensitive member was measured at a position of the developing device by replacing the developing device with a jig fixed so that a probe for potential measurement might be located at a position of 130 mm from an end of the electrophotographic photosensitive member. The electrophotographic photosensitive member was set so that the dark portion potential in a non-exposed region might be −450 V, and the surface of the electrophotographic photosensitive member was irradiated with a laser beam, and then the light portion potential photo-induced discharged from the dark portion potential was measured. Using plain paper of A4 size, an image was continuously reproduced on 2,000 sheets of the paper, and the amount of fluctuation between the light portion potentials before and after the reproduction was evaluated. A test chart having a printing rate of 5% was used. The result is shown in Table 4 as the potential fluctuation.

<Evaluation of Relative Value of Torque>

Under the same conditions as those for the above potential fluctuation evaluation, a drive current value (current value A) of a rotary motor for the electrophotographic photosensitive member was measured. This evaluation was made to find an amount of the contact stress between the electrophotographic photosensitive member and the cleaning blade. The magnitude of the current value indicates that of the amount of the contact stress between the electrophotographic photosensitive member and the cleaning blade.

Further, an electrophotographic photosensitive member for comparison of the torque relative value was prepared by the following method.

An electrophotographic photosensitive member was produced in the same manner as that in Example 1 except that the polyester resin A(1) used for the binder resin of the charge transport layer of the electrophotographic photosensitive member in Example 1 was replaced with the polyester resin C(1). The obtained electrophotographic photosensitive member was used as an electrophotographic photosensitive member for comparison.

Using the produced electrophotographic photosensitive member for comparison, the drive current value (current value B) of the rotary motor for the electrophotographic photosensitive member was measured in the same manner as that in Example 1.

Calculation was made to find a ratio of the drive current value (current value A) of the rotary motor for the electrophotographic photosensitive member using the polyester resin A according to the present invention to the drive current value (current value B) of the rotary motor for the electrophotographic photosensitive member not using the polyester resin A according to the present invention. The obtained value of (current value A)/(current value B) was used as a relative value of the torque for comparison. The numerical value of the relative value of the torque represents increase and decrease in the amount of the contact stress between the electrophotographic photosensitive member and the cleaning blade, and a smaller numerical value of the relative value of the torque shows a smaller amount of the contact stress between the electrophotographic photosensitive member and the cleaning blade. The result is shown in the relative value of the initial torque in Table 4.

Next, using plain paper of A4 size, an image was continuously reproduced on 2,000 sheets of the paper. A test chart having a printing rate of 5% was used. Subsequently, the relative value of the torque was measured after the electrophotographic photosensitive member was repeatedly used to reproduce images on 2,000 sheets. The relative value of the torque after the repeated use of the electrophotographic photosensitive member for the image reproduction of 2,000 sheets was evaluated in the same manner as that in evaluation of the relative value of the initial torque. In this case, the electrophotographic photosensitive member for comparison was also repeatedly used to reproduce images on 2,000 sheets, and the relative value of the torque after the repeated use of the electrophotographic photosensitive member for the image reproduction on 2,000 sheets was calculated using the drive current value at that time. The result is shown in Table 4 as the relative value of the torque after 2,000 sheets are printed.

<Evaluation of Matrix-Domain Structure>

Concerning the electrophotographic photosensitive member produced by the above method, the charge transport layer was vertically cut and the cross section was observed using an ultra-high depth shape measurement microscope VK-9500 (made by Keyence Corporation). At that time, the observation of the cross section was conducted at a magnification of the objective lens of 50 fold and in a visual field of a 100-μm square in the surface of the electrophotographic photosensitive member (10,000 $\mu m^2$), and largest diameters of 100 formed domain areas selected at random in the visual field were measured. An average value was determined by calculation from the thus obtained largest diameters of the 100 domains and was defined as a number average particle diameter. The result is also shown in Table 4.

EXAMPLES 2 to 45

Electrophotographic photosensitive members were produced and evaluated in the same manner as that in Example 1 except that the binder resin of the charge transport layer in Example 1 was changed as shown in Table 2. It was confirmed that in the formed charge transport layer, the domain made of the polyester resin A was included in the matrix made of the charge transporting material and the polyester resin C or the polycarbonate resin D. As an electrophotographic photosensitive member for comparison of the torque relative value was used an electrophotographic photosensitive member containing only a resin having another structure shown in Table 2 as the corresponding resin in the charge transport layer. The result is shown in Table 4.

COMPARATIVE EXAMPLE 1

An electrophotographic photosensitive member was produced in the same manner as that in Example 1 except that a polyester resin (E) was used as the binder resin, the polyester resin (E) having the repeating structural unit represented by the above formula (1-1) and the repeating structural unit represented by the above formula (2-1), and containing the siloxane moiety in an amount of 2% by mass. The constitution of the resin contained in the charge transport layer and the content of the siloxane moiety are shown in Table 3. Evaluation was made in the same manner as that in Example 1. As an electrophotographic photosensitive member for comparison of the torque relative value in all the Comparative Examples was used an electrophotographic photosensitive member containing only the polyester resin C(1) as the binder resin. The result is shown in Table 4.

COMPARATIVE EXAMPLE 2

An electrophotographic photosensitive member was produced in the same manner as that in Example 1 except that in Example 1, a polyester resin (E) was used as the binder resin instead of the polyester resin A(1). The constitution of the resin contained in the charge transport layer and the content of the siloxane moiety are shown in Table 3. Evaluation was made in the same manner as that in Example 1. The result is shown in Table 4.

COMPARATIVE EXAMPLE 3

An electrophotographic photosensitive member was produced in the same manner as that in Example 1 except that a polyester resin (F) was used as the binder resin, the polyester resin (F) having the repeating structural unit represented by the above formula (1-1) and the repeating structural unit represented by the above formula (2-1) and containing the siloxane moiety in an amount of 50% by mass in the polyester resin. The constitution of the resin contained in the charge transport layer and the content of the siloxane moiety are shown in Table 3. Evaluation was made in the same manner as that in Example 1. The result is shown in Table 4.

COMPARATIVE EXAMPLE 4

An electrophotographic photosensitive member was produced in the same manner as that in Example 1 except that in Example 1, the polyester resin (F) was used as the binder resin instead of the polyester resin A(1). The constitution of the resin contained in the charge transport layer and the content of the siloxane moiety are shown in Table 3. It was confirmed that in the charge transport layer, the domain made of the polyester resin (F) was formed in the matrix made of the charge transporting material and the polyester resin C(1). Evaluation was made in the same manner as that in Example 1. The result is shown in Table 4.

COMPARATIVE EXAMPLE 5

An electrophotographic photosensitive member was produced in the same manner as that in Example 1 except that in Example 1 a polyester resin (G) was used instead of the polyester resin A(1) as the binder resin, the polyester resin (G) having the repeating structural unit represented by the following formula (G):

(G)

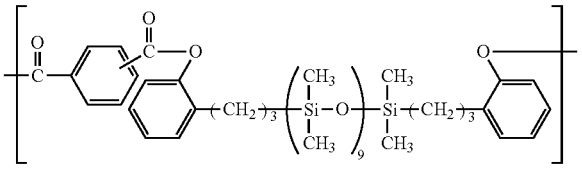

the polyester resin (G) containing the siloxane moiety in an amount of 20% by mass in the polyester resin (a molar ratio of p-phenylene and m-phenylene of 5:5 and a weight average molecular weight of 120,000). The constitution of the resin contained in the charge transport layer and the content of the siloxane moiety are shown in Table 3. Evaluation was made in the same manner as that in Example 1. The result is shown in Table 4.

COMPARATIVE EXAMPLE 6

An electrophotographic photosensitive member was produced in the same manner as that in Example 1 except that in Example 1 a polyester resin (H) was used instead of the polyester resin A(1) as the binder resin, the polyester resin (H) having the repeating structural unit represented by the above formula (3-2) and the structure represented by the following formula (H) at a terminal thereof:

(H)

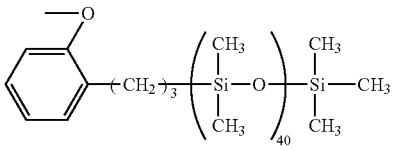

the polyester resin (H) containing the siloxane moiety in an amount of 1.2% by mass in the polyester resin (a molar ratio of p-phenylene and m-phenylene of 5:5). The constitution of the resin contained in the charge transport layer and the content of the siloxane moiety are shown in Table 3. Evaluation was made in the same manner as that in Example 1. The result is shown in Table 4.

COMPARATIVE EXAMPLE 7

An electrophotographic photosensitive member was produced in the same manner as that in Example 1 except that in Example 1 a polycarbonate resin (M) was used instead of the polyester resin A(1) as the binder resin and the blending ratio was changed, the polycarbonate resin (M) having the repeating structural unit represented by the above formula (4-4) and the repeating structural unit represented by the following formula (I):

(I)

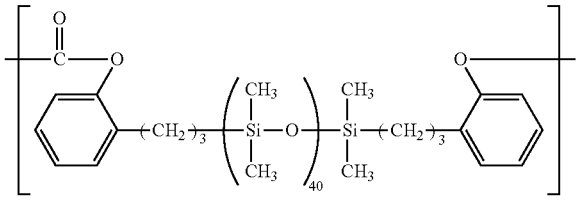

the polycarbonate resin (M) containing the siloxane moiety in an amount of 84% by mass in the polycarbonate resin. The constitution of the resin contained in the charge transport layer and the content of the siloxane moiety are shown in Table 3. Evaluation was made in the same manner as that in Example 1. The result is shown in Table 4.

COMPARATIVE EXAMPLE 8

An electrophotographic photosensitive member was produced in the same manner as that in Example 1 except that a polycarbonate resin (N) having the structural unit represented by the above formula (4-4) and the structure represented by the above formula (H) at a terminal thereof and containing the siloxane moiety in an amount of 20% by mass in the resin was used instead of the polyester resin A(1) in Example 1. The constitution of the resin contained in the charge transport layer and the content of the siloxane moiety are shown in Table 3. Evaluation was made in the same manner as that in Example 1. The result is shown in Table 4.

COMPARATIVE EXAMPLE 9

The layers were formed in the same manner as that in Example 1 until the charge generation layer was formed.

Next, a coating liquid for a charge transport layer was prepared by dissolving 8 parts of the compound represented by the above formula (CTM-1), 2 parts of the compound represented by the above formula (CTM-2) (charge transporting material), 9.9 parts of the polyester resin C(1), and 0.1 parts of methylphenyl polysiloxane in a mixed solvent of 20 parts of dimethoxymethane and 60 parts of chlorobenzene.

This coating liquid for a charge transport layer was applied onto the charge generation layer by dip coating, and dried at 120° C. for 1 hour to form a charge transport layer having a thickness of 19 μm. It was confirmed that in the charge transport layer, the domain made of methylphenyl polysiloxane was formed in the matrix made of the charge transporting material and the polyester resin C(1).

Thus, an electrophotographic photosensitive member in which the charge transport layer was the surface layer was produced.

Evaluation was made in the same manner as that in Example 1. The result is shown in Table 4.

TABLE 2

| | Resin A (Polyester resin A) | Mass ratio A of siloxane (% by mass) | Resin B (resin having another structure) | Repeating structural unit of resin B | m-phenylene/p-phenylene ratio | Blending ratio of resin A and resin B | Mass ratio B of siloxane (% by mass) |
|---|---|---|---|---|---|---|---|
| Example 1 | Polyester resin A (1) | 20 | Polyester resin C (1) | (3-1) | 5/5 | A/B = 3/7 | 6 |
| Example 2 | Polyester resin A (1) | 20 | Polyester resin C (1) | (3-1) | 5/5 | A/B = 4/6 | 8 |
| Example 3 | Polyester resin A (1) | 20 | Polyester resin C (1) | (3-1) | 5/5 | A/B = 1/9 | 2 |
| Example 4 | Polyester resin A (1) | 20 | Polyester resin C (2) | (3-8) | — | A/B = 3/7 | 6 |
| Example 5 | Polyester resin A (1) | 20 | Polycarbonate resin D (1) | (4-4) | — | A/B = 3/7 | 6 |
| Example 6 | Polyester resin A (2) | 20 | Polyester resin C (3) | (3-2) | 5/5 | A/B = 3/7 | 6 |
| Example 7 | Polyester resin A (3) | 20 | Polyester resin C (4) | (3-3) | 5/5 | A/B = 3/7 | 6 |

TABLE 2-continued

| | Resin A (Polyester resin A) | Mass ratio A of siloxane (% by mass) | Resin B (resin having another structure) | Repeating structural unit of resin B | m-phenylene/p-phenylene ratio | Blending ratio of resin A and resin B | Mass ratio B of siloxane (% by mass) |
|---|---|---|---|---|---|---|---|
| Example 8 | Polyester resin A (4) | 20 | Polyester resin C (5) | (3-6) | 5/5 | A/B = 2/8 | 4 |
| Example 9 | Polyester resin A (4) | 20 | Polycarbonate resin D (2) | (4-5) | — | A/B = 5/5 | 10 |
| Example 10 | Polyester resin A (5) | 20 | Polyester resin C (6) | (3-1)/(3-7) = 7/3 | 5/5 | A/B = 3/7 | 6 |
| Example 11 | Polyester resin A (6) | 10 | Polyester resin C (3) | (3-2) | 5/5 | A/B = 3/7 | 3 |
| Example 12 | Polyester resin A (6) | 10 | Polyester resin C (3) | (3-2) | 5/5 | A/B = 1/9 | 1 |
| Example 13 | Polyester resin A (6) | 10 | Polycarbonate resin D (3) | (4-2) | — | A/B = 3/7 | 3 |
| Example 14 | Polyester resin A (7) | 30 | Polyester resin C (3) | (3-2) | 5/5 | A/B = 3/7 | 9 |
| Example 15 | Polyester resin A (7) | 30 | Polyester resin C (3) | (3-2) | 5/5 | A/B = 5/5 | 15 |
| Example 16 | Polyester resin A (7) | 30 | Polycarbonate resin D (4) | (4-3) | — | A/B = 3/7 | 9 |
| Example 17 | Polyester resin A (8) | 30 | Polyester resin C (7) | (3-9) | — | A/B = 2/8 | 6 |
| Example 18 | Polyester resin A (8) | 30 | Polyester resin C (7) | (3-9) | — | A/B = 5/5 | 15 |
| Example 19 | Polyester resin A (8) | 30 | Polycarbonate resin D (3) | (4-2) | — | A/B = 3/7 | 9 |
| Example 20 | Polyester resin A (9) | 20 | Polyester resin C (8) | (3-4) | 5/5 | A/B = 4/6 | 8 |
| Example 21 | Polyester resin A (9) | 20 | Polycarbonate resin D (5) | (4-1) | — | A/B = 4/6 | 8 |
| Example 22 | Polyester resin A (10) | 30 | Polyester resin C (8) | (3-4) | 5/5 | A/B = 4/6 | 12 |
| Example 23 | Polyester resin A (10) | 30 | Polyester resin C (8) | (3-4) | 5/5 | A/B = 2/8 | 6 |
| Example 24 | Polyester resin A (11) | 30 | Polyester resin C (4) | (3-3) | 5/5 | A/B = 3/7 | 9 |
| Example 25 | Polyester resin A (11) | 30 | Polycarbonate resin D (4) | (4-3) | — | A/B = 3/7 | 9 |
| Example 26 | Polyester resin A (12) | 20 | Polyester resin C (1) | (3-1) | 5/5 | A/B = 3/7 | 6 |
| Example 27 | Polyester resin A (12) | 20 | Polyester resin C (1) | (3-1) | 5/5 | A/B = 1/9 | 2 |
| Example 28 | Polyester resin A (12) | 20 | Polyester resin C (2) | (3-8) | — | A/B = 3/7 | 6 |
| Example 29 | Polyester resin A (13) | 10 | Polyester resin C (1) | (3-1) | 5/5 | A/B = 3/7 | 3 |
| Example 30 | Polyester resin A (13) | 10 | Polyester resin C (1) | (3-1) | 5/5 | A/B = 1/9 | 1 |
| Example 31 | Polyester resin A (14) | 10 | Polyester resin C (1) | (3-1) | 5/5 | A/B = 3/7 | 3 |
| Example 32 | Polyester resin A (14) | 10 | Polyester resin C (1) | (3-1) | 5/5 | A/B = 1/9 | 1 |
| Example 33 | Polyester resin A (15) | 5 | Polyester resin C (1) | (3-1) | 5/5 | A/B = 4/6 | 2 |
| Example 34 | Polyester resin A (15) | 5 | Polyester resin C (1) | (3-1) | 5/5 | A/B = 2/8 | 1 |
| Example 35 | Polyester resin A (16) | 5 | Polyester resin C (9) | (3-11) | — | A/B = 4/6 | 2 |
| Example 36 | Polyester resin A (16) | 5 | Polyester resin C (9) | (3-11) | — | A/B = 2/8 | 1 |
| Example 37 | Polyester resin A (17) | 20 | Polyester resin C (10) | (3-14) | — | A/B = 3/7 | 6 |
| Example 38 | Polyester resin A (17) | 20 | Polycarbonate resin D (3) | (4-2) | — | A/B = 3/7 | 6 |
| Example 39 | Polyester resin A (18) | 20 | Polyester resin C (11) | (3-12) | — | A/B = 3/7 | 6 |
| Example 40 | Polyester resin A (19) | 20 | Polycarbonate resin D (6) | (4-6) | — | A/B = 3/7 | 6 |
| Example 41 | Polyester resin A (20) | 20 | Polyester resin C (1) | (3-1) | 5/5 | A/B = 3/7 | 6 |
| Example 42 | Polyester resin A (21) | 20 | Polyester resin C (1) | (3-1) | 5/5 | A/B = 3/7 | 6 |
| Example 43 | Polyester resin A (22) | 30 | Polyester resin C (12) | (3-5) | 5/5 | A/B = 4/6 | 12 |
| Example 44 | Polyester resin A (23) | 20 | Polyester resin C (1) | (3-1) | 5/5 | A/B = 3/7 | 6 |
| Example 45 | Polyester resin A (24) | 20 | Polyester resin C (1) | (3-1) | 5/5 | A/B = 3/7 | 6 |

"Resin A (polyester resin A)" in Table 2 means the polyester resin A having the repeating structural unit represented by the above formula (1) and the repeating structural unit represented by the above formula (2).

"Mass ratio A of siloxane (% by mass)" in Table 2 means the content (% by mass) of the siloxane moiety in "Resin A (polyester resin A)".

"Resin B (resin having another structures)" in Table 2 means at least one of the polyester resin C and the polycarbonate resin D.

"Mass ratio B of siloxane (% by mass)" in Table 2 means the content (% by mass) of the siloxane moiety in "Resin A (polyester resin A)" based on the total mass of all the binder resins in the charge transport layer.

TABLE 3

| | Resin A (polyester resin) | Mass ratio A of siloxane (% by mass) | Resin B (resin having another structure) | Repeating structural unit of Resin B | m-phenylene/p-phenylene ratio | Blending ratio of Resin A and Resin B | Mass ratio B of siloxane (% by mass) |
|---|---|---|---|---|---|---|---|
| Comparative Example 1 | Polyester resin (E) | 2 | — | — | — | — | 2 |
| Comparative Example 2 | Polyester resin (E) | 2 | Polyester resin C (1) | (3-1) | 5-5 | A/B = 3/7 | 0.6 |
| Comparative Example 3 | Polyester resin (F) | 50 | — | — | — | — | 50 |
| Comparative Example 4 | Polyester resin (F) | 50 | Polyester resin C (1) | (3-1) | 5-5 | A/B = 3/7 | 15 |

TABLE 3-continued

| | Resin A (polyester resin) | Mass ratio A of siloxane (% by mass) | Resin B (resin having another structure) | Repeating structural unit of Resin B | | Blending ratio of Resin A and Resin B | Mass ratio B of siloxane (% by mass) |
|---|---|---|---|---|---|---|---|
| | | | | | m-phenylene/ p-phenylene ratio | | |
| Comparative Example 5 | Polyester resin (G) | 20 | Polyester resin C (1) | (3-1) | 5-5 | A/B = 3/7 | 6 |
| Comparative Example 6 | Polyester resin (H) | 1.2 | Polyester resin C (1) | (3-1) | 5-5 | A/B = 3/7 | 0.36 |
| Comparative Example 7 | Polycarbonate resin (M) | 84 | Polyester resin C (1) | (3-1) | 5-5 | A/B = 1/9 | 8.4 |
| Comparative Example 8 | Polycarbonate resin (N) | 20 | Polyester resin C (1) | (3-1) | 5-5 | A/B = 3/7 | 6 |
| Comparative Example 9 | Phenylmethyl polysiloxane | 100 | Polyester resin C (1) | (3-1) | 5-5 | A/B = 1/99 | 1 |

"Resin A" in Table 3 means a resin having the siloxane moiety.

"Mass ratio A of siloxane (% by mass)" in Table 3 means the content (% by mass) of the siloxane moiety in "Resin A."

"Resin B (resin having another structure)" in Table 3 means a resin having a structure including no siloxane moiety.

"Mass ratio B of siloxane (% by mass)" in Table 3 means the content (% by mass) of the siloxane moiety in "Resin A" based on the total mass of all the binder resins in the charge transport layer.

TABLE 4

| | Potential fluctuation (V) | Relative value of initial torque | Relative value of torque after 2,000 sheets are printed | Number average particle diameter (nm) |
|---|---|---|---|---|
| Example 1 | 5 | 0.75 | 0.80 | 180 |
| Example 2 | 5 | 0.68 | 0.72 | 120 |
| Example 3 | 5 | 0.78 | 0.85 | 220 |
| Example 4 | 5 | 0.78 | 0.78 | 190 |
| Example 5 | 8 | 0.75 | 0.82 | 210 |
| Example 6 | 10 | 0.70 | 0.76 | 200 |
| Example 7 | 14 | 0.70 | 0.75 | 220 |
| Example 8 | 8 | 0.78 | 0.80 | 170 |
| Example 9 | 14 | 0.70 | 0.74 | 200 |
| Example 10 | 35 | 0.60 | 0.90 | 550 |
| Example 11 | 10 | 0.70 | 0.85 | 250 |
| Example 12 | 5 | 0.77 | 0.90 | 200 |
| Example 13 | 5 | 0.80 | 0.84 | 200 |
| Example 14 | 25 | 0.78 | 0.88 | 150 |
| Example 15 | 40 | 0.80 | 0.88 | 520 |
| Example 16 | 14 | 0.74 | 0.90 | 220 |
| Example 17 | 10 | 0.68 | 0.74 | 270 |
| Example 18 | 25 | 0.65 | 0.70 | 150 |
| Example 19 | 14 | 0.68 | 0.72 | 180 |
| Example 20 | 5 | 0.82 | 0.88 | 130 |
| Example 21 | 5 | 0.85 | 0.88 | 140 |
| Example 22 | 15 | 0.65 | 0.70 | 280 |
| Example 23 | 8 | 0.84 | 0.88 | 140 |
| Example 24 | 10 | 0.64 | 0.68 | 210 |
| Example 25 | 8 | 0.70 | 0.75 | 170 |
| Example 26 | 12 | 0.74 | 0.78 | 160 |
| Example 27 | 8 | 0.75 | 0.78 | 120 |
| Example 28 | 10 | 0.80 | 0.90 | 150 |
| Example 29 | 8 | 0.81 | 0.91 | 140 |
| Example 30 | 5 | 0.84 | 0.92 | 120 |
| Example 31 | 10 | 0.84 | 0.90 | 140 |
| Example 32 | 7 | 0.80 | 0.85 | 100 |
| Example 33 | 8 | 0.82 | 0.88 | 120 |
| Example 34 | 8 | 0.84 | 0.88 | 200 |
| Example 35 | 5 | 0.80 | 0.88 | 220 |
| Example 36 | 5 | 0.82 | 0.92 | 120 |
| Example 37 | 8 | 0.78 | 0.82 | 320 |
| Example 38 | 8 | 0.73 | 0.85 | 350 |
| Example 39 | 5 | 0.68 | 0.68 | 110 |
| Example 40 | 20 | 0.72 | 0.77 | 230 |
| Example 41 | 8 | 0.78 | 0.83 | 210 |
| Example 42 | 14 | 0.77 | 0.81 | 170 |
| Example 43 | 12 | 0.68 | 0.72 | 250 |
| Example 44 | 5 | 0.64 | 0.70 | 180 |
| Example 45 | 5 | 0.65 | 0.67 | 150 |

TABLE 4-continued

| | Potential fluctuation (V) | Relative value of initial torque | Relative value of torque after 2,000 sheets are printed | Number average particle diameter (nm) |
|---|---|---|---|---|
| Comparative Example 1 | 80 | 0.98 | 0.98 | — |
| Comparative Example 2 | 30 | 1.00 | 1.00 | — |
| Comparative Example 3 | 190 | 0.60 | 0.95 | — |
| Comparative Example 4 | 150 | 0.65 | 0.75 | 900 |
| Comparative Example 5 | 5 | 0.97 | 0.97 | — |
| Comparative Example 6 | 8 | 0.95 | 0.98 | — |
| Comparative Example 7 | 15 | 0.68 | 0.95 | — |
| Comparative Example 8 | 25 | 0.79 | 0.93 | — |
| Comparative Example 9 | 150 | 0.88 | 0.95 | 600 |

Comparing the Examples with Comparative Example 1, in the case where the siloxane has a small mass ratio based on the polyester resin containing the siloxane moiety in the charge transport layer, the effect of relaxing the contact stress is not sufficiently obtained. This is demonstrated by the fact that no effect in reduction of the torque is seen in the evaluation of the initial torque and the torque after 2,000 sheets are printed.

Comparing the Examples with Comparative Example 2, in the case where the siloxane has a small mass ratio based on the polyester resin containing the siloxane moiety, the matrix-domain structure is not formed, and the effect of relaxing the contact stress is not obtained in spite of mixing the polyester resin with the polyester resin C according to the present invention.

Comparing the Examples with Comparative Example 3, in the case where the siloxane has a large mass ratio based on the polyester resin containing the siloxane moiety in the charge transport layer, compatibility of the polyester resin with the charge transporting material is insufficient, and it is observed that the charge transporting material aggregates in the polyester resin containing the siloxane moiety. The aggregation shows that potential fluctuation occurs.

Comparing the Examples with Comparative Example 4, in the case where the siloxane has a large mass ratio based on the polyester resin containing the siloxane moiety, formation of the matrix-domain structure is observed similarly to the case of the polyester resin A according to the present invention, and the effect of relaxing the stress is continuously obtained. However, it turns out that the potential fluctuation is large. By observation with a microscope, an aggregate of the charge transporting material is recognized in the domain. This shows that the mass ratio of siloxane to the polyester resin containing the siloxane moiety is important in terms of an effect of controlling potential fluctuation.

Comparing the Examples with Comparative Example 5, in the case where the average value of the number of repetition of the siloxane moiety in the polyester resin having the siloxane moiety in the charge transport layer is small, the effect of relaxing the contact stress is not sufficiently obtained. This is demonstrated by the fact that no effect in reduction of the torque is seen in the evaluation of the initial torque and the torque after 2,000 sheets are printed. As mentioned above, it is shown that the effect of relaxing the contact stress is dependent on the length of the siloxane chain. The effect of the present application is also obtained as long as the polyester resin having the siloxane moiety according to the present invention is used even if the average value of the number of repetition of the siloxane moiety is 10. This shows that the cycloalkylene structure of the polyester resin A having the siloxane moiety according the present invention realizes the effect of the present invention.

Comparing the Examples with Comparative Example 6, in the case of the polyester resin having the siloxane structure only at the terminals, it is shown that the siloxane has a smaller mass ratio based on the polyester resin containing the siloxane moiety in the charge transport layer and a smaller mass ratio based on all the binder resins in the charge transport layer because of the structure of the polyester resin, and the effect of relaxing the contact stress is not sufficiently obtained. Unlike the polyester resin A according to the present invention, the matrix-domain structure is not formed. As mentioned above, it is shown that the effect of relaxing the contact stress and formation of the matrix-domain structure are also dependent on disposition of the siloxane moiety in the polyester resin.

Comparing the Examples with Comparative Example 7, in the case where the polycarbonate resin having the siloxane structure and a larger mass ratio of siloxane is mixed with the polyester resin containing no siloxane moiety, it is shown that the effect of relaxing the contact stress is not sustained. It is thought that this results from manifestation of the surface migration properties of the polycarbonate resin having the siloxane structure and a large mass ratio of siloxane.

Comparing the Examples with Comparative Example 8, in the case of using the polycarbonate resin having the siloxane structure in which the mass ratio of the siloxane moiety is adjusted so that the matrix-domain structure may not be formed even if the polycarbonate resin is mixed with the polyester resin, it results in suppressing the potential fluctuation. However, with respect to continuous or sustainable stress relaxation, a favorable result is obtained in the present invention forming the matrix-domain structure. This shows that while a large amount of the siloxane moiety needs to be contained in the charge transport layer in order to continuously relax the stress, formation of the matrix-domain structure is effective to achieve both the suppression of deterioration in the potential fluctuation and the sustainment of the stress relaxation.

Comparing the Examples with Comparative Example 9, in the case of the charge transport layer containing phenylmethyl siloxane, formation of the matrix-domain structure is seen and sustained effect of continuously relaxing the contact stress is observed, but the potential fluctuation is increased. It is known that silicone oil materials having a siloxane structure such as phenylmethyl siloxane adversely affect the potential. It is thought that such an adverse effect manifests itself when such a silicone oil material migrates to an interface between the charge generation layer and the charge transport layer in the laminated structure photosensitive member. It is thought that potential fluctuation occurs because while migration of the silicone oil material to the vicinity of the interface is suppressed by introduction of the phenyl group, it is not sufficient. On the other hand, in the case of the polyester resin having the siloxane structure according to the present invention, it is thought that migration to the interface is suppressed because the polyester resin is a resin having not only the siloxane moiety but also an ester structure and that potential fluctuation is further controlled by the formation of the domain.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-006850, filed Jan. 15, 2010, No. 2011-003785, filed Jan. 12, 2011, which are hereby incorporated by reference herein in their entirety.

What is claimed is:

1. An electrophotographic photosensitive member comprising a support, a charge generation layer provided on the support, and a charge transport layer provided on the charge generation layer, the charge transport layer being a surface layer of the electrophotographic photosensitive member, wherein the charge transport layer contains:

a charge transporting material, a polyester resin A having a repeating structural unit represented by the following formula (1) and a repeating structural unit represented by the following formula (2), and, at least one of a polyester resin C having a repeating structural unit represented by the following formula (C) and a polycarbonate resin D having a repeating structural unit represented by the following formula (D);

the polyester resin A contains a siloxane moiety in an amount of from 5% by mass or more to 30% by mass or less based on the total mass of the polyester resin A; and the charge transport layer has a matrix-domain structure comprising a matrix made of the charge transporting material and at least one of the polyester resin C and the polycarbonate resin D, and a domain made of the polyester resin A and formed in the matrix:

(1)

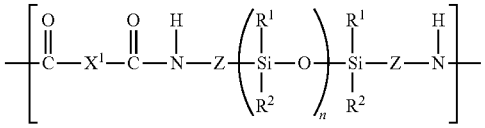

wherein $X^1$ represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom; $R^1$ and $R^2$ each independently represent a substituted or unsubstituted alkyl group, or a substituted or unsubstituted aryl group; Z represents a substituted or unsubstituted alkylene group having from 1 or more to 4 or less carbon atoms; and n represents an average value of the number of repetition of the structure in the parenthesis, and is from 20 or more to 200 or less;

(2)

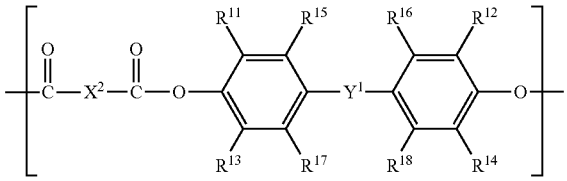

wherein $R^{11}$ to $R^{18}$ each independently represent a hydrogen atom or a substituted or unsubstituted alkyl group; $X^2$ represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom; and $Y^1$ represents a single bond, a substituted or unsubstituted alkylene group, a substituted or unsubstituted arylene group or an oxygen atom;

(C)

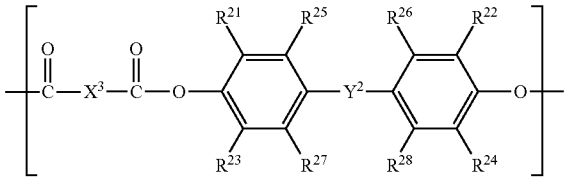

wherein $R^{21}$ to $R^{28}$ each independently represent a hydrogen atom or a substituted or unsubstituted alkyl group; $X^3$ represents a substituted or unsubstituted alkylene group, a substituted or unsubstituted arylene group, a substituted or unsubstituted biphenylene group, or a divalent group in which a plurality of phenylene groups are bonded together through an alkylene group or an oxygen atom; and $Y^2$ represents a single bond, a substituted or unsubstituted alkylene group or an oxygen atom;

(D)

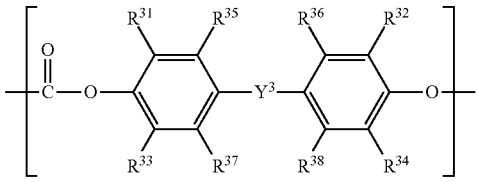

wherein $R^{31}$ to $R^{38}$ each independently represent a hydrogen atom or a substituted or unsubstituted alkyl group; and $Y^3$ represents a single bond, a substituted or unsubstituted alkylene group or an oxygen atom.

2. The electrophotographic photosensitive member according to claim 1, wherein said charge transport layer contains the siloxane moiety in an amount of from 1% by mass or more to 20% by mass or less based on the total mass of all the binder resins in the charge transport layer.

3. The electrophotographic photosensitive member according to claim 1, wherein n in the formula (1) is from 40 or more to 150 or less.

4. A process cartridge comprising and integrally supporting the electrophotographic photosensitive member according to claim 1, and at least one device selected from the group consisting of a charging device, a developing device, a transfer device and a cleaning device, the process cartridge being detachably provided in a main body of an electrophotographic apparatus.

5. An electrophotographic apparatus comprising the electrophotographic photosensitive member according to claim 1, a charging device, an exposure device, a developing device and a transfer device.

* * * * *